US007626188B2

(12) United States Patent
Shirai et al.

(10) Patent No.: US 7,626,188 B2
(45) Date of Patent: Dec. 1, 2009

(54) LIGHT SOURCE DEVICE FOR PRODUCING EXTREME ULTRAVIOLET RADIATION AND METHOD OF GENERATING EXTREME ULTRAVIOLET RADIATION

(75) Inventors: Takahiro Shirai, Gotenba (JP); Hiroto Sato, Gotenba (JP); Kazunori Bessho, Gotenba (JP); Yusuke Teramoto, Gotenba (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 359 days.

(21) Appl. No.: 11/830,297

(22) Filed: Jul. 30, 2007

(65) Prior Publication Data

US 2008/0048134 A1 Feb. 28, 2008

(30) Foreign Application Priority Data

Jul. 28, 2006 (JP) ..... 2006-205807

(51) Int. Cl.
*H05H 1/04* (2006.01)

(52) U.S. Cl. ..... 250/504 R

(58) Field of Classification Search ..... 250/504 R
See application file for complete search history.

(56) References Cited

U.S. PATENT DOCUMENTS

| | | | | |
|---|---|---|---|---|
| 6,972,421 | B2 | 12/2005 | Melnychuk et al. | |
| 7,339,181 | B2 * | 3/2008 | Taylor et al. | 250/504 R |
| 2004/0184014 | A1 | 9/2004 | Bakker et al. | |
| 2007/0090304 | A1 | 4/2007 | Jonkers et al. | |

FOREIGN PATENT DOCUMENTS

| | | | |
|---|---|---|---|
| EP | 1 406 124 | A1 | 4/2004 |
| WO | 2005/004555 | A1 | 1/2005 |
| WO | 2005/101924 | A1 | 10/2005 |
| WO | 2006/056917 | A1 | 6/2006 |

OTHER PUBLICATIONS

Present Status and Future of EUV (Extreme Ultra Violet) Light Source Research; J. Plasma Fusion Res., vol. 79, No. 3 (2003); pp. 219-220; English Abstracts and Figure Captions.

European Patent Office Search Report, Application No. EP 07 01 4791, May 11, 2007.

* cited by examiner

*Primary Examiner*—Kiet T Nguyen
(74) *Attorney, Agent, or Firm*—David S. Safran; Roberts Mlotkowski Safran & Cole, P.C.

(57) ABSTRACT

Electrode ablation is controlled in EUV light source device that gasifies a raw material by irradiation with an energy beam and produces a high-temperature plasma using electrodes a raw material for plasma is dripped in a space in the vicinity of, but other than, the discharge region and from which the gasified raw material can reach the discharge region between the discharge electrodes and a laser beam irradiates the high-temperature plasma raw material. A gasified high-temperature plasma raw material, gasified by the laser beam, spreads in the direction of the discharge region. At this time, power is applied on a pair of discharge electrodes, the gasified high-temperature plasma raw material is heated and excited to become a high-temperature plasma, and EUV radiation is emitted. This EUV radiation is collected by an EUV collector mirror and sent to lithography equipment.

14 Claims, 12 Drawing Sheets

LIGHT SOURCE DEVICE FOR PRODUCING EXTREME ULTRAVIOLET RADIATION AND METHOD OF GENERATING EXTREME ULTRAVIOLET RADIATION

BACKGROUND OF THE INVENTION

1. Field of the Invention

This invention is directed to an extreme ultraviolet light source device that generates extreme ultraviolet radiation by means of plasma produced by means of discharge, and a method of generating extreme ultraviolet radiation. In particular, it concerns an extreme ultraviolet light source device that generates extreme ultraviolet radiation by means of plasma produced by means of discharge, using an energy beam to gasify high-temperature plasma raw material for the generation of extreme ultraviolet radiation when the raw material is supplied to the vicinity of the discharge electrodes, and a method of generating extreme ultraviolet radiation.

2. Description of Related Art

With the miniaturization and higher integration of semiconductor integrated circuits, there are demands for improved resolution in projection lithography equipment used in manufacturing integrated circuits. Lithography light source wavelengths have gotten shorter, and an extreme ultraviolet light source device (hereafter, EUV light source device) that emits extreme ultraviolet (hereafter, EUV) radiation with wavelengths from 13 to 14 nm, and particularly, the wavelength of 13.5 nm, have been developed as a next-generation semiconductor lithography light source to follow excimer laser equipment to meet these demands.

A number of methods of generating EUV radiation are known in EUV light source device; one of these is a method in which high-temperature plasma is generated by heating and excitation of an EUV radiation fuel and extracting the EUV radiation emitted by the plasma.

EUV light source device using this method can be roughly divided, by the type of high-temperature plasma production, into LPP (laser-produced plasma) type EUV light source devices and DPP (discharge-produced plasma) type EUV light source devices (see, "Recent Status and Future of EUV (Extreme Ultraviolet) Light Source Research," J. Plasma Fusion Res., Vol. 79 No. 3, P219-260, March 2003, for example).

LPP-type EUV light source devices use EUV radiation from a high-temperature plasma produced by irradiating a solid, liquid, or gaseous target with a pulsed laser.

DPP-type EUV light source devices, on the other hand, use EUV radiation from a high-temperature plasma produced by electrical current drive.

A radiation fuel that emits 13.5 nm EUV radiation—that is, for example decavalent Xe (xenon) ions as a high-temperature plasma raw material for generation of EUV—is known in both these types of EUV light source devices, but Li (lithium) and Sn (tin) ions have been noted as a high-temperature plasma raw material that yields a greater radiation intensity. For example, Sn has a conversion efficiency, which is the ratio of 13.5 nm wavelength EUV radiation intensity to the input energy for generating high-temperature plasma that is several times greater than that of Xenon.

In the DPP type in recent years, a method has been proposed, in International Patent Application Publication WO 2005-025280 A2 and corresponding U.S. Patent Application Publication 2007/090304, of using a laser beam or other energy beam to irradiate and gasify solid or liquid Sn or Li delivered to the surface of electrodes to produce discharge, and then producing high-temperature plasma by means of discharge. The EUV light source device described in these publications is explained below with reference to FIG. 10 which is a cross-section of the EUV light source device shown in FIG. 1 of those publications.

Disk-shaped electrodes 114, 116 are located in a discharge space 112 where the pressure is regulated to the specified value. Electrodes 114, 116 are separated by a specified gap in a previously defined region 118, and rotate about an axis of rotation 146.

A raw material 124 produces high-temperature plasma for emitting 13.5 nm wavelength EUV radiation. The high-temperature plasma raw material 124 is a heated metal melt, and is held in a container 126. The temperature of the metal melt 124 is regulated by a temperature regulation means located in the container 126.

The electrodes 114, 116 are located such that a portion of each electrode is submerged in the container 126 that holds the metal melt. The liquid metal melt 124 that is carried on the surface of the electrodes 114, 116 is transported to the surface of the region 118 by the rotation of the electrodes 114, 116. The metal melt 124 that is transported to the surface of the region 118 (that is, the metal melt 124 that is present on the surfaces of the electrodes 114, 116 that are separated by a specified gap in the region 118) is irradiated by a laser beam 120 from a laser (not shown). The metal melt 124 that is irradiated by the laser beam 120 is gasified.

With the metal melt 124 gasified by irradiation by the laser beam 120, application of pulsed power on the electrodes 114, 116 starts a pulsed discharge in the region 118, and a plasma 122 is formed. The plasma 122, heated and excited by a large electrical current during discharge, attains a high temperature, and EUV radiation is generated from this high-temperature plasma. The EUV radiation passes through a debris trap 138 and is extracted from above in the Figure.

A pulsed power generator 148 is electrically connected to the metal melt 124 held in the container 126. The metal melt 124 is conductive, and so electrical energy is supplied from the pulsed power generator 148, through the metal melt 124, to the electrodes 114, 116 that are partially submerged in the metal melt 124.

By means of this type, Sn or Li that are solid at normal temperature are easily gasified in the vicinity of the discharge region where the discharge is generated (the space where a discharge between the electrodes is generated). That is, it is possible to supply easily gasified Sn or Li to the discharge region, and so it is possible to effectively extract EUV radiation of a 13.5 nm wavelength following discharge.

Further, in the EUV light source device described in International Patent Application Publication WO 2005-025280 A2 and corresponding U.S. Patent Application Publication 2007/090304, the electrodes are rotated, which has the following advantages:

(i) it is possible to constantly deliver new solid or liquid high-temperature plasma raw material, which is the EUV generation fuel high-temperature plasma raw material, to the discharge region; and (ii) because the position on the surface of the electrodes that is irradiated by the laser beam and where the high-temperature plasma is generated is constantly changing, and so thermal load and erosion of the electrodes can be prevented.

Nevertheless, there are the following problems associated with the equipment indicated in the described in International Patent Application Publication WO 2005-025280 A2 and corresponding U.S. Patent Application Publication 2007/090304. That is, by means of the EUV light source device described, the surface of the electrodes is irradiated every time EUV radiation is generated. When the EUV light source device is used as a light source for lithography, EUV radiation is repeatedly generated from several kHz to several tens of kHz. Further, it often happens that the EUV light source device continues in operation all day long. Therefore, the electrodes are liable to be worn down by laser abrasion.

SUMMARY OF THE INVENTION

This invention is directed to overcoming the prior technical problems described above. Thus, an objection of the invention is to suppress ablation of the electrodes caused by irradiating the electrodes with an energy beam in DPP-type EUV light source devices in which liquid or solid high-temperature plasma raw material supplied to the discharge region is gasified by a laser beam or other energy beam irradiation, after which a high-temperature plasma is produced by electrode discharge and EUV radiation is extracted.

The EUV light source device of this invention is a DPP-type EUV light source device in which the radiation fuel that emits 13.5 nm wavelength EUV radiation, by gasifying a liquid or solid high-temperature plasma raw material, such as Sn or Li, with a laser beam or other energy beam irradiation, after which a high-temperature plasma is produced by electrode discharge and EUV radiation is extracted, in which the high-temperature plasma raw material is not supplied to the discharge electrode surface, but rather to the vicinity of the discharge region, or in other words, to a space other than the discharge region, from which the gasified raw material can reach the discharge region. Therefore, the raw material in this space is irradiated with a laser beam and gasified. At that time, it is desirable that the position irradiated by the energy beam be within a region on the surface of the raw material where the raw material faces the discharge region.

DETAILED DESCRIPTION OF THE INVENTION

Figure 1A:
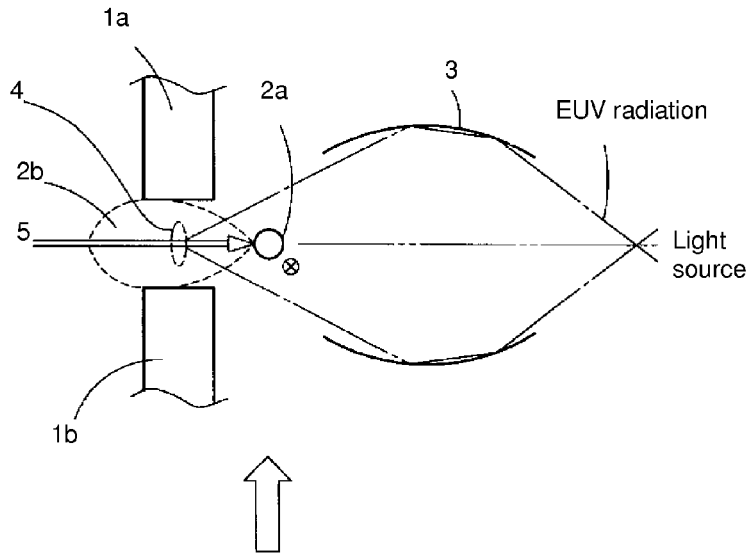
FIGS. 1(*a*) & 1(*b*) are diagrams for explaining the EUV light source device of this invention.
Figure 1B:
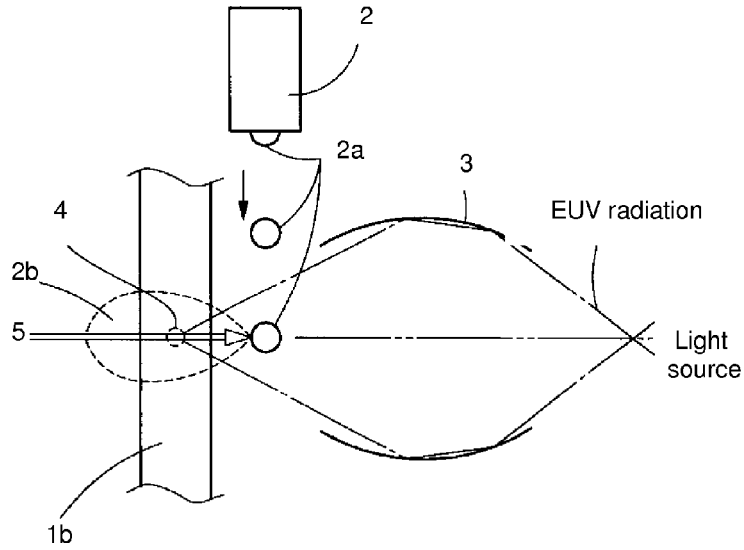

The following explanation uses the explanatory diagrams shown in FIGS. 1(*a*) & 1(*b*) to explain the EUV light source device of this invention in which FIG. 1(*a*) is a top view and 1(*b*) is a front view. That is, FIG. 1(*b*) is a view seen from the direction of the arrow in FIG. 1(*a*).

The high-temperature plasma raw material is not supplied to the surface of the electrodes, but to a space in the vicinity of the discharge region (between the electrodes); that is, to a space other than the discharge region, from which the raw material gasified by the laser beam can reach the discharge region (hereafter, this space is called "the vicinity of the discharge region"). In the example shown in FIGS. 1(*a*) & 1(*b*), the high-temperature plasma raw material 2*a* is supplied (dripped) by the raw material supply means 2 in the direction of the pull of gravity (in a direction perpendicular to the surface of the paper in FIG. 1(*a*) and in the top-to-bottom direction in FIG. 1(*b*)).

The laser beam 5 or other energy beam (a laser beam is taken as an example hereafter) irradiates the high-temperature plasma raw material 2*a* that is dripped. The position of irradiation is the position where the dripped high-temperature plasma raw material 2*a* has reached the vicinity of the discharge region.

In the example shown in FIG. 1, paired, plate-shaped electrodes 1*a*, 1*b* are positioned with specified gap between them. The discharge region is located in the gap between the paired electrodes 1*a*, 1*b*. The high-temperature plasma raw material 2*a* is supplied by the raw material supply means 2 to the space between the paired electrodes 1*a*, 1*b* and the extreme ultraviolet radiation collector mirror 3 (hereafter, the "EUV collector mirror 3") and in the direction of gravitational pull toward the vicinity of the discharge space.

When the high-temperature plasma raw material 2*a* reaches the vicinity of the discharge region, the laser beam 5 irradiates the high-temperature plasma raw material 2*a*. The high-temperature plasma raw material 2*a* that is gasified by irradiation from the laser beam 5 expands, centered on the normal line of the surface of the high-temperature plasma raw material 2*a* that is hit by the laser beam 5. For that reason, if the laser beam 5 irradiates the side of the high-temperature plasma raw material 2*a* supplied by the raw material supply means 2 that faces the discharge region, the gasified high-temperature plasma raw material 2*a* will expand in the direction of the discharge region. If power from the power supply means (not shown) is applied to the paired electrodes 1*a*, 1*b* at this time, a discharge will be generated in the discharge region, and electrical current will flow in the discharge region.

The gasified high-temperature plasma raw material 2*b* is excited by heating by that electrical current to become high-temperature plasma, and EUV radiation is emitted. That EUV radiation is collected by the EUV collector mirror 3 and sent to the lithography equipment (not shown).

As described above, the EUV light source device of this invention supplies the high-temperature plasma raw material, not to the discharge region, but to the vicinity of the discharge region, where the high-temperature plasma raw material is irradiated by the laser beam. For that reason, the laser beam does not irradiate the electrode directly, and so it is possible to achieve the effect of not producing wear by laser ablation of the electrodes.

The EUV collector mirror 3 described often constitutes a grazing incidence optical system that sets the collecting direction so that the optical axis is one direction. Generally, in constituting this sort of grazing incidence optical system, an EUV collector mirror with a structure in which multiple thin, concave mirrors are arranged with high precision in a nested fashion is used. In an EUV collector mirror with such a structure, the multiple thin, concave mirrors are supported by a support column that roughly matches the optical axis and a backing that extends outward from the support column.

In FIG. 1, the laser beam 5 is introduced from the direction of the optical axis specified by the EUV collector mirror, and irradiates the high-temperature plasma raw material 2*a*. For that reason, if there is slippage in the alignment between the laser beam 5 irradiation position and the position of the high-temperature plasma raw material, the laser beam 5 may irradiate the EUV collector mirror 3, in which case damage to the EUV collector mirror 3 could occur.

Figure 2A:
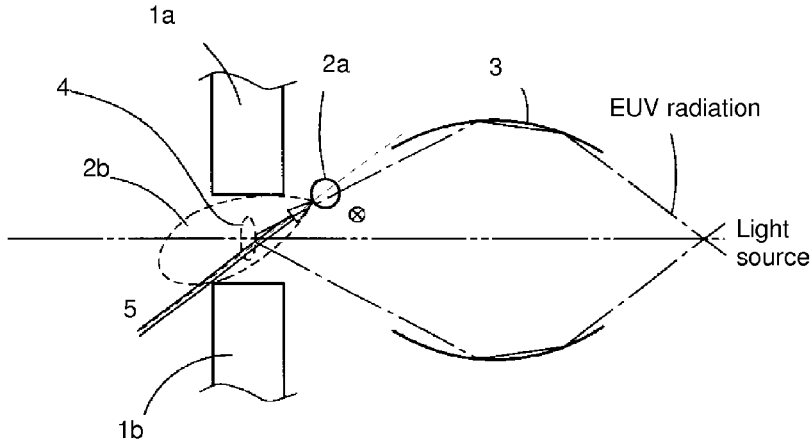
FIGS. 2(*a*) & 2(*b*) are additional diagrams for explaining the EUV light source device of this invention.

In the event that it is necessary to keep a laser beam 5 from hitting the EUV collector mirror 3 during faulty irradiating of the laser beam 5, the direction of the laser beam 5 can be adjusted as shown in FIGS. 2(*a*) & 2(*b*) so that it does not hit the EUV collector mirror 3.

FIG. 2(*a*) shows the laser beam 5 irradiating from the electrode 1*a*, 1*b* side in a direction toward the collector mirror 3 so that it is slanted with respect to the optical axis of the collector mirror 3. FIG. 2(*b*) shows the laser beam 5 irradiating from the collector mirror 3 in a direction toward the electrode so that it is slanted with respect to the optical axis of the collector mirror 3.

The following problem arises when the laser beam 5 irradiates as shown in FIG. 2(*b*). As stated previously, the high-temperature plasma raw material gasified by laser beam irradiation expands, centered on the normal line of the surface of the high-temperature plasma raw material that is hit by the laser beam. Therefore, when the laser beam irradiates the side of the surface of the high-temperature plasma raw material that faces the discharge region, the gasified high-temperature plasma raw material expands in the direction of the discharge region. Then a part of the gasified high-temperature plasma raw material supplied to the discharge region by means of laser beam irradiation that is not involved in the formation of high-temperature plasma by the discharge, or a part of the cluster of atomic gas decomposed and produced as a result of plasma formation, contacts the low-temperature portion in the EUV light source device and accumulates as debris. For example, if the high-temperature plasma raw material is Sn, a part that is not involved in the formation of high-temperature plasma by the discharge, or a part of the cluster of metallic Sn, Sn, atomic gas decomposed and produced as a result of plasma formation, contacts the low-temperature portion in the EUV light source device as debris and produces a tin mirror.

Figure 2B:
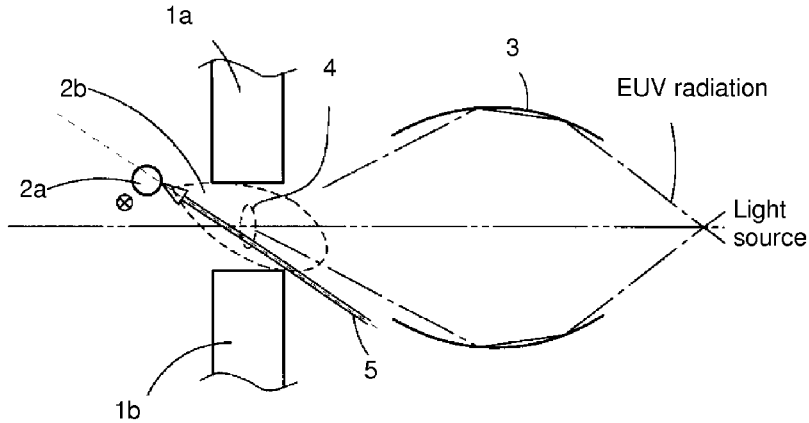

In other words, in the event that the high-temperature plasma raw material 2*a* is supplied to a space on the opposite side of the paired electrodes 1*a*, 1*b* from the EUV collector mirror 3, as shown in FIG. 2*b*, the laser beam will irradiate the high-temperature plasma raw material from the EUV collector mirror 3 side, and gasified high-temperature plasma raw material 2*b* will be supplied to the discharge region. In that case, the high-temperature plasma raw material 2*b* that is gasified by irradiation with the laser beam 5 will spread in the direction of the discharge region and the EUV collector mirror 3, as shown in FIG. 2(*b*), and debris will be released in the direction of the EUV collector mirror 3 by laser beam irradiation of the high-temperature plasma raw material and the discharge generated between the electrodes. In the event that debris accumulates on the EUV collector mirror 3, the efficiency with which the EUV collector mirror 3 reflects 13.5 nm will be reduced, and the capabilities of the EUV light source device will deteriorate.

Therefore, it is preferable that the high-temperature plasma raw material 2*a* be supplied to a space between the paired electrodes 1*a*, 1*b* and the EUV collector mirror 3 and a space in the vicinity of the discharge region, as shown in FIG. 1 and FIG. 2(*a*). When the laser beam 5 irradiates the high-temperature plasma raw material 2*a* supplied in this way, on the side of the surface of the high-temperature plasma raw material that faces the discharge region, as described above, the gasified high-temperature plasma raw material 2*b* will expand in the direction of the discharge region; it will not expand in the direction of the EUV collector mirror 3. In other words, it is possible to suppress the progression of debris toward the EUV collector mirror 3 by means of supplying the high-temperature plasma raw material and setting the position of laser beam irradiation as described above.

Figure 3A:
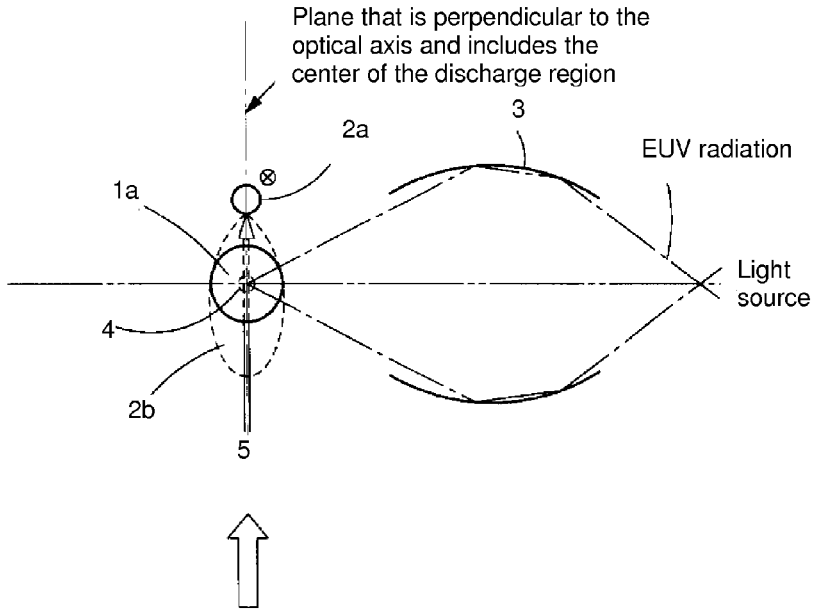
FIGS. 3(*a*) & 3(*b*) are further diagrams for explaining the EUV light source device of this invention.
Figure 3B:
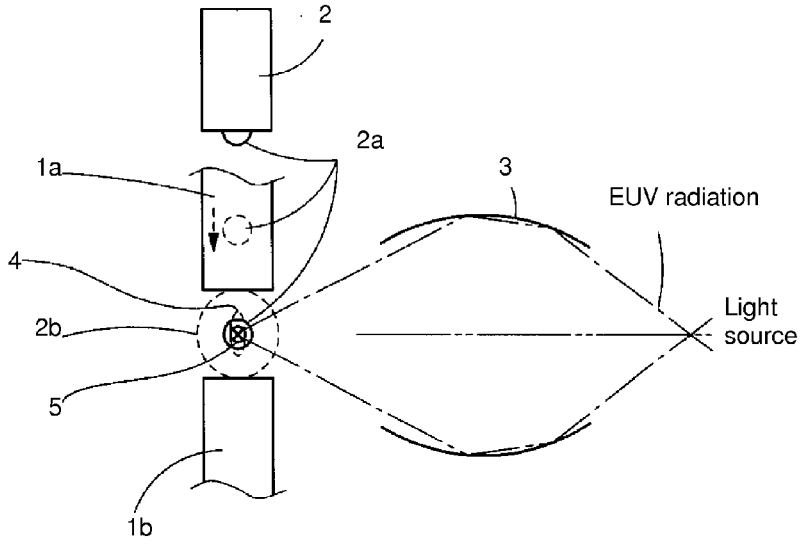

The case in which the paired electrodes 1*a*, 1*b* are separated by a specified gap having a columnar shape is shown in FIGS. 3(*a*) & 3(*b*), FIG. 3(*b*) being a view as seen from the direction of the arrow in FIG. 3(*a*). In this case, the high-temperature plasma raw material 2*a* is supplied to a space in a plane that is perpendicular to the optical axis of the EUV collector mirror 3 and that includes the center of the discharge region; the laser beam 5 irradiates the high-temperature plasma raw material 2*a* in a direction that is perpendicular to that optical axis, and although it irradiates from the discharge region side, the gasified high-temperature plasma raw material 2*b* is supplied on the discharge region side and does not expand in the direction of the EUV collector mirror 3. Therefore, hardly any debris is released toward the EUV collector mirror 3 by laser beam irradiation of the high-temperature plasma raw material and discharge generated between the electrodes. Now, even when columnar electrodes are used, of course, it is all right for the raw material supply means to supply the high-temperature plasma raw material to a space between the paired electrodes and the EUV collector mirror and a space in the vicinity of the discharge region.

On the basis of the above, the following previously stated problems are resolved by this invention as follows:

(1) Extreme ultraviolet light source devices having a vessel, a raw material supply means that supplies a liquid or solid raw material to the vessel for emission of extreme ultraviolet radiation, an energy beam radiation means, which by means of an energy beam irradiates the raw material and gasifies the raw material, a pair of discharge electrodes separated by a specified gap for high-temperature excitation of the gasified raw material and generation of a high-temperature plasma by means of electrical discharge in the vessel, a pulsed power supply means that supplies pulsed power to the discharge electrodes, a collector optical means that collects the extreme ultraviolet radiation emitted by the high-temperature plasma produced in the discharge region of the discharge by the pair of discharge electrodes, and an extreme ultraviolet radiation extractor that extracts the condensed extreme ultraviolet radiation, the energy beam irradiation means emits an energy beam irradiating raw material supplied to a space other than the discharge region, from which the gasified raw material can reach the discharge region.

(2) In (1) above, the raw material supply means supplies the raw material to a space between the discharge region and the collector optical means, and the energy beam radiation means sets the energy beam irradiation position in the region on the surface of the raw material where the raw material faces the discharge region.

(3) In (1) above, the raw material supply means supplies the raw material in a plane that is perpendicular to the optical axis of the collector optical means and includes the center of the discharge region, and the energy beam irradiation means sets the energy beam irradiation position in the region on the surface of the raw material where the raw material faces the discharge region.

(4) In (1), (2), or (3) above, there is also a magnetic field application means that applies a magnetic field to the discharge region that is roughly parallel to the direction of the discharge produced between the pair of discharge electrodes.

(5) In (1), (2), (3), or (4) above, the supply of raw material from the raw material supply means is performed by dripping the raw material in the form of droplets in the direction of gravity.

(6) In (1), (2), (3), or (4) above, the energy beam is a laser beam.

(7) In (1), (2), (3), or (4) above, the pair of discharge electrodes is driven so as to change the position of discharge generation on the electrode surface.

(8) In (1), (2), (3), or (4) above, the paired discharge electrodes are disk-shaped electrodes and the discharge electrode drive is a rotary drive.

(9) In (8) above, the paired, disk-shaped discharge electrodes face each other with the outer edges separated by a specified gap.

EFFECT OF THE INVENTION

The following effects can be achieved with this invention.

(1) The energy beam irradiates raw material supplied to a space other than the discharge region, from which the gasified raw material can reach the discharge region, and so the energy beam does not irradiate the electrodes directly. For this reason, wear of the electrodes by laser ablation does not occur as in the past.

(2) Because the raw material is supplied to a space between the discharge region and the collector optical means and the energy beam irradiation position is set to a region on the surface of the raw material where the raw material faces the discharge region, the gasified high-temperature plasma raw material expands in the direction of the discharge region; it does not expand in the direction of the EUV collector mirror. For that reason, it is possible both to supply high-temperature plasma raw material to the discharge region and to suppress the progression of debris toward the EUV collector mirror 3.

(3) Because the raw material is supplied in a plane that is perpendicular to the optical axis of the collector optical means and includes the center of the discharge region and because the position irradiated by the energy beam is set by the energy beam irradiation means to the region on the surface of the raw material where the raw material faces the discharge region, as in (2) above, it is possible both to supply gasified high-temperature plasma raw material to the discharge region and to suppress the progression of debris toward the EUV collector mirror 3.

(4) Because there is a magnetic field application means that applies a magnetic field to the discharge region that is roughly parallel to the direction of the discharge produced between the pair of discharge electrodes, the turning radius of the helically moving charged particles is reduced and it is possible to reduce the amount of dispersion of high-temperature plasma, reduce the plasma size, and raise the collection efficiency.

(5) Because the raw material is dripped in the direction of the pull of gravity in the form of droplets, even if there is a change in the state of release of high-temperature plasma raw material released from the raw material supply means, the direction of the raw material supply is a single direction; the position in which the raw material supply means is installed can be set simply, and recovery of the plasma raw material is also made easy. Further, it is relatively easy to regulate the amount of raw material supplied.

(6) Because the paired electrodes can be driven so that the position on the surface of the electrodes in which discharge occurs changes, as by constituting them as electrodes that rotate during discharge, the position on the two electrodes in which pulsed discharge occurs during discharge changes with each pulse. Consequently, the thermal load received by the first and second discharge electrodes is smaller, and it is possible to reduce the speed of discharge electrode wear and to lengthen the lifetime of the discharge electrodes. Further, because the disk-shaped paired discharge electrodes are arranged so that the edge portion of the periphery of the two electrodes are separated from each other by a specified gap, it is possible to generate the most discharge where the gap between the edges is smallest, and to stabilize the discharge position.

PREFERRED EMBODIMENTS OF THE INVENTION

An explanation of a basic embodiment of the extreme ultraviolet (EUV) light source device of this invention follows. The following explanation is primarily of an EUV light source device having disk-shaped, paired rotating electrodes, but it also applies to the EUV light source device with plate-shaped or columnar electrodes shown in FIGS. 1 through 3.

1. The First Embodiment

Figure 4:
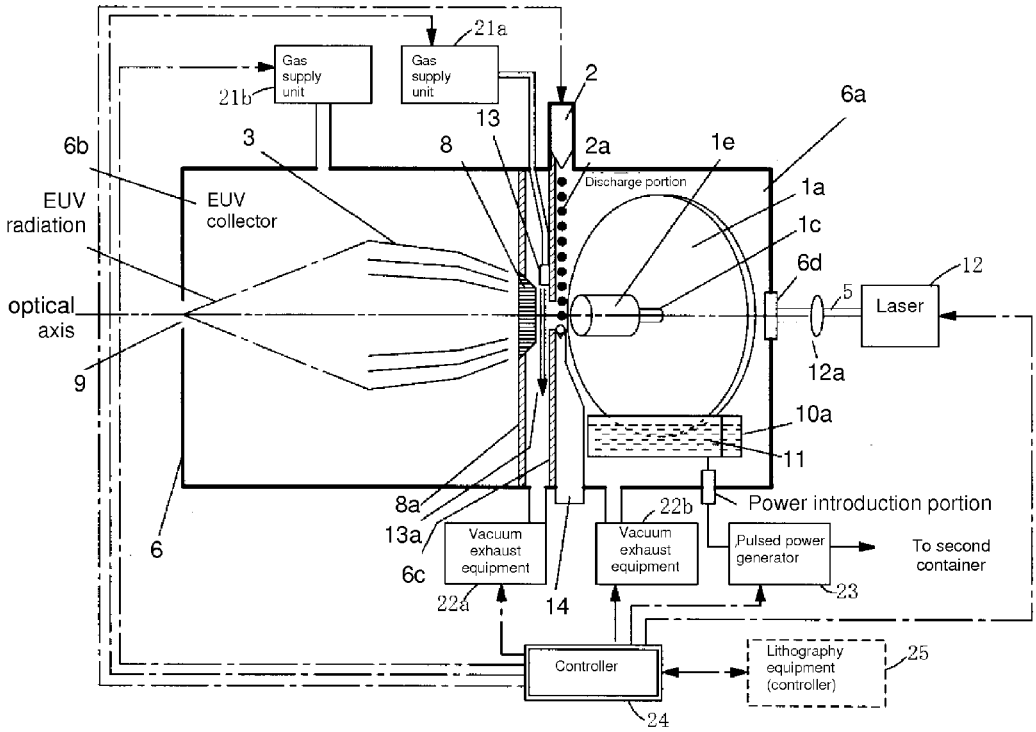
FIG. 4 is a block diagram (front view) of a first embodiment of the EUV light source device of this invention.
Figure 5:
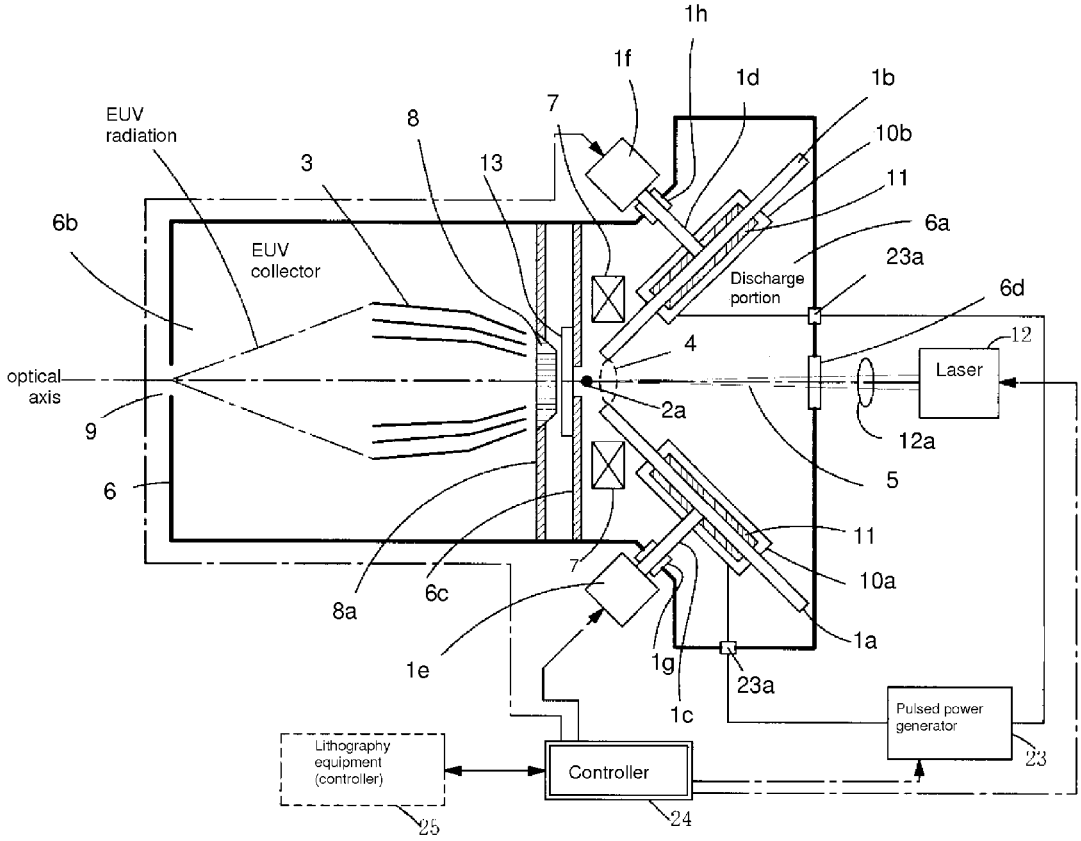
FIG. 5 is a block diagram (top view) of the first embodiment of the EUV light source device of this invention.

FIGS. 4 & 5 are block diagrams of the first embodiment (in cross section) of the extreme ultraviolet (EUV) light source device of this invention. FIG. 4 is a front view of the EUV light source device of this invention; the EUV radiation is emitted from the left side of the diagram. FIG. 5 is a top view of the EUV light source device of this invention.

The EUV light source device shown in FIGS. 4 & 5 has a chamber 6 that is the discharge chamber. The chamber 6 is largely divided into two spaces by a partition 6*c* with an opening in it. One of these spaces is the discharge portion, which is a heating and excitation means that heats and excites the high-temperature plasma raw material 2*a*, which includes the EUV radiation fuel. The discharge portion is constituted with such things as the paired electrodes. The other space is the EUV collector mirror portion. The EUV radiation that is emitted by the high-temperature plasma produced by the heating and excitation of the high-temperature plasma raw material 2*a* is collected in the EUV collector mirror portion, and the EUV collector mirror 3 that guides EUV radiation from the radiation extraction part 9 in the chamber 6 to the optical system of the lithography equipment, illustration of which has been omitted, is located in the EUV collector mirror portion, as is the debris trap that suppresses the movement to the EUV collector mirror portion of debris produced as a result of the production of plasma by means of discharge. In this embodiment, the debris trap comprises a gas curtain 13*a* and a foil trap 8 as shown in FIGS. 4, 5. Hereafter, the space in which the discharge portion is located will be called the discharge space 6*a* and the space in which the EUV collector mirror portion is located will be called the collector mirror space 6*b*.

Vacuum exhaust equipment 22*b* is connected to the discharge space 6*a* and vacuum exhaust equipment 22*a* is connected to the collector mirror space 6*b*. Now, the foil trap 8 is supported within the collector mirror space 6*b* of the chamber 6 by, for example, a foil trap support partition 8*a*. In other words, in the example shown in FIGS. 4 and 5, the collector mirror space 6*b* is further divided into two spaces by the foil trap support partition 8*a*. Now, the discharge portion is shown larger than the EUV collector mirror portion in FIGS. 4 & 5, but this is for ease of understanding; the actual size relationship is not as shown in FIGS. 4 & 5. In reality, the EUV collector mirror portion is larger than the discharge portion. In other words, the collector mirror space 6*b* is larger than the discharge space 6*a*.

The specific constitution and operation of the various parts of this EUV light source device are explained below.

(1) Discharge portion: The discharge portion comprises the first discharge electrode 1*a*, which is a circular disk-shaped piece made of metal, and the second discharge electrode 1*b*, which is similarly a circular disk-shaped piece made of metal. The first and second discharge electrodes 1*a*, 1*b* are made of a high-melting-point metal, such as tungsten, molybdenum, or tantalum, and they are positioned to face each other separated by a specified gap. Of the two electrodes here, one is the ground side electrode and the other is the high-voltage side electrode. The surface of the two electrodes 1*a*, 1*b* can be positioned in the same plane, but it is preferable to position them as shown in FIG. 5, with the edges at the periphery where the electrical field is concentrated when the power is applied facing each other across a specified gap so that the discharge is more easily generated. That is, it is preferable that the electrodes be positioned so that the hypothetical planes containing the surface of each electrode intersect. The gap between the edges at the periphery of the two electrodes is the shortest length for the specified gap mentioned above.

As described hereafter, when pulsed power is applied to the two electrodes 1*a*, 1*b* by the pulsed power generator 23, a discharge will be generated at the edge portions of the electrodes. Generally speaking, the shorter the gap between the edges at the periphery of the electrodes is, the more discharge will be generated. Consider, tentatively, the case of the surface of the two electrodes being located in the same plane. In that case, the gap between the sides of the electrodes would be the shortest length for the specified gap. In this case, the position in which the discharge is generated would be on the hypothetical contact line where the side of a disc-shaped electrode would contact the hypothetical plane perpendicular to that side. The discharge could be generated at any position on the hypothetical contact line of each electrode. Therefore, in the event that the surfaces of the two electrodes were located in the same plane, it is possible that the discharge position would not be stable. When, on the other hand, the edges at the periphery of the electrodes 1*a*, 1*b* face each other across a specified gap as shown in FIG. 5, the gap at the edge of the peripheries of the two electrodes 1*a*, 1*b* will be the shortest distance and will generate the most discharge as described above, so the discharge position will be stable. Hereafter, the space in which the discharge between the two electrodes is generated is called the discharge region.

As stated above, in the event that the edges at the periphery of the electrodes are positioned facing each other across the specified gap, then, when viewed from above as in FIG. 5, the first and second electrodes are positioned in a radiating state centered on the line of intersection of the hypothetical planes that contain the surfaces of the two electrodes. In FIG. 5, the portion where the gap between the edges on the periphery of the two electrodes positioned in a radiating state is the longest is placed on the opposite side from the EUV collector mirror described below, when the line of intersection of the hypothetical planes mentioned above is taken as the center. Here, the portion where the gap between the edges on the periphery of the two electrodes 1*a*, 1*b* positioned in a radiating state is the longest, when the line of intersection of the hypothetical planes is taken as the center, could be positioned on the same side as the EUV collector mirror 3. In that case, however, the separation of the discharge region and the EUV collector mirror 3 would be lengthened and the EUV collection efficiency would be reduced to that extent, so that is not practical.

As stated above, DPP-type EUV light source devices use EUV radiation from high-temperature plasma produced by electrical current drive by discharge, and the high-temperature plasma raw material heating and excitation means is a large electrical current from discharge generated between paired discharge electrodes. Therefore, the discharge electrodes bear the large thermal load that accompanies discharge. Further, the high-temperature plasma is generated in the electrodes vicinity, and so the discharge electrodes also bear the thermal load from the plasma. Because of this thermal load, the discharge electrodes gradually wear and generate metallic debris.

The EUV light source device, if used as a light source for lithography equipment, uses an EUV collector mirror 3 to collect the EUV radiation emitted from the high-temperature plasma, and releases this collected EUV radiation to the lithography equipment side. Metallic debris damages the EUV collector mirror and degrades the EUV reflection efficiency of the EUV collector mirror. Further, the shape of the discharge electrodes is changed by the gradual wear. Because of that, the discharge generated between the discharge electrodes gradually becomes unstable, and as a result, the generation of EUV radiation becomes unstable.

When a DPP-type EUV light source device is used as the light source for mass-production semiconductor lithography equipment, it is necessary to suppress that sort of discharge electrode wear and lengthen the service life of the discharge electrodes as much as possible. In response to that necessity, the EUV light source device shown in FIGS. 4 & 5 is constituted with a first discharge electrode 1*a* and a second discharge electrode 1*b* that are disk-shaped and that rotate, at least during discharge. That is, rotating the first and second discharge electrodes 1*a*, 1*b* changes, with each pulse, the position on the two electrodes where the pulsed discharge is generated. Therefore, the thermal load borne by the first and second discharge electrodes 1*a*, 1*b* is smaller, the speed of discharge electrode wear is reduced, and it is possible to lengthen the service life of the discharge electrodes. Hereafter, the first discharge electrode 1*a* is called the first rotating electrode and the second discharge electrode 1*b* is called the second rotating electrode.

Specifically, a rotating shaft 1*c* of a first motor 1*e* and a rotating shaft 1*d* of a second motor 1*f* are attached at roughly the center portions of the disk-shaped first rotating electrode 1*a* and the second rotating electrode 1*b*, respectively. The first motor 1*e* and the second motor 1*f* rotate the rotating shafts 1*c*, 1*d*, and thus, rotate the first rotating electrode 1*a* and the second rotating electrode 1*b*. Now, the direction of rotation is not particularly prescribed. Here, the rotating shafts 1*c*, 1*d* are introduced into the chamber 6 through mechanical seals 1*g*, 1*h*. The mechanical seals 1*g*, 1*h* allow the rotation of the rotating shafts 1*c*, 1*d* while maintaining the reduced-pressure air tightness of the chamber 6.

As shown in FIG. 4, the first rotating electrode 1*a* is placed so that a part of it is submerged in a first container 10*a* that holds a conductive metal melt for power supply 11. Similarly, the second rotating electrode 1*b* is placed so that a part of it is submerged in a second container 10*b* that holds a conductive metal melt for power supply 11. The first container 10*a* and the second container 10*b* are connected to a pulsed power generator 23 through an insulated power introduction portion 23*a* that can maintain the reduced-pressure air tightness of the chamber 6. As described above, the first and second containers 10*a*, 10*b* and the metal melt for power supply 11 are conductive and parts of the first rotating electrode 1*a* and the second rotating electrode 1*b* are submerged in the metal melt for power supply 11, and so applying pulsed power from the pulsed power generator between the first container 10*a* and the second container 10*b* applies pulsed power between the first rotating electrode and the second rotating electrode.

Any metal that does not affect EUV radiation during discharge can be used as the metal melt for power supply 11. The metal melt for power supply 11 also functions as a means of cooling the discharge position of the rotating electrodes 1*a*, 1*b*. While not shown, the first container 10*a* and the second container 10*b* have temperature regulation means that maintain the metal melt in a molten state.

The pulsed power generator 23 applies pulsed power with a short pulse width between the first container 10*a* and the second container 10*b*—that is, between the first rotating electrode and the second rotating electrode—which are its load, through a magnetic pulse compression circuit that comprises a capacitor and a magnetic switch.

(2) Raw material supply and raw material gasification mechanism: The high-temperature plasma raw material 2*a* that emits extreme ultraviolet radiation is supplied in liquid or solid state from a raw material supply means 2 installed in the chamber 6 to the vicinity of the discharge region (the space between the edge on the periphery of the first rotating electrode and the edge on the periphery of the second rotating electrode, which is the space where the discharge is generated). The raw material supply means 2 can be mounted on the top wall of the chamber 6, for example, with the high-temperature plasma raw material 2*a* supplied (dripped) in the form of droplets into the space in the vicinity of the discharge region described above. When the high-temperature plasma raw material 2*a* supplied in the form of droplets drips down and reaches the space in the vicinity of the discharge region, it is irradiated and gasified by a laser beam emitted from a laser 12. The laser beam 5 is condensed by a condenser lens or other condensed optical system 12*a*, passes through the aperture 6*d* of the chamber 6, and is concentrated as a condensed beam on the high-temperature plasma raw material 2*a*.

Figure 11:
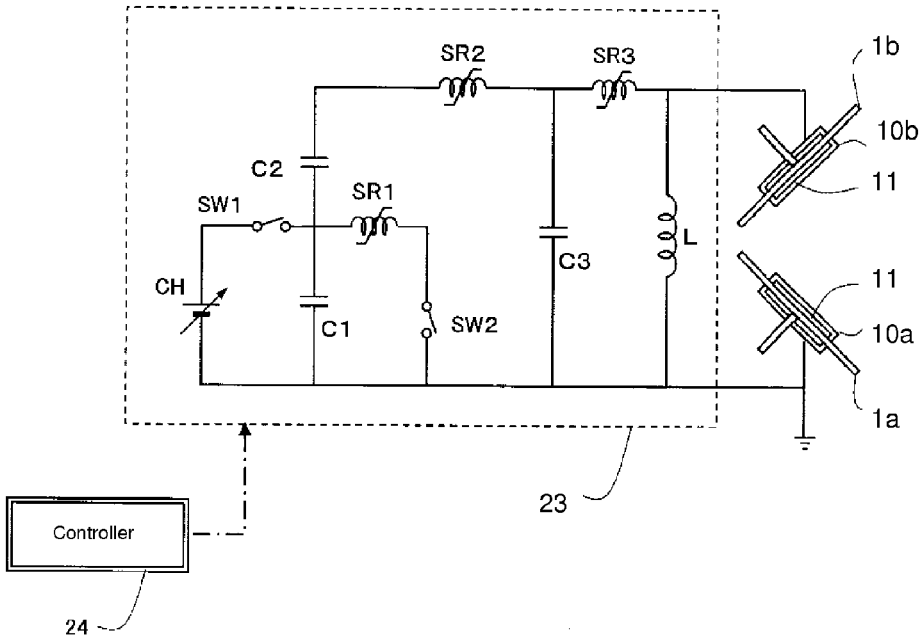
FIG. 11 is an example of the constitution of a pulsed power generator 23 in which the LC reversal method is adopted.

FIG. 11 is an example of the constitution of a pulsed power generator 23 in which the LC inversion method is adopted. The pulsed power generator 23 shown in FIG. 11 has a two-stage magnetic pulse compression circuit that uses two magnetic switches SR2, SR3. Those comprise saturable reactors. The magnetic switch SR1 is to reduce the switching losses in SW2, and is also called a magnetic assist.

The constitution and operation of the circuit are explained below with reference to FIG. 11. First, the charging switch SW1 is turned ON. For example, a solid-state switch that is a semiconductor switching element such as an IGBT is used as the charging switch SW1. The charging voltage from a charger CH is adjusted to a specified value (Vset), and the charger CH is in an active state. As a result, the capacitors C1, C2 are charged to the specified voltage. The switch SW2 is OFF at this time. After the charging of the capacitors C1, C2 is completed, the active state of the charger CH turns OFF, and the switch SW1 for the charger also turns OFF. Thereafter, the switch SW2 turns ON. As in the case of the charging switch SW1, a solid-state switch that is a semiconductor switching element such as an IGBT, for example, is used as the charging switch SW2.

When the switch SW2 is turned ON, the voltage of the capacitor C1 is applied primarily to the two terminals of the magnetic switch SR1. Thereafter, the magnetic switch SR1 becomes saturated and turns ON. The period from when voltage is applied to the magnetic switch SR1 until the magnetic switch SR1 is turned ON is the period until the switch SW2 is turned completely ON. That is, the magnetic switch SR1 holds voltage until the switch SW2 is completely ON.

When the magnetic switch SR1 turns on, the charge stored in the capacitor C1 discharges through the capacitor C1→magnetic switch SR1-switch SW2→capacitor C1 loop and the polarity of the capacitor C1 reverses. When the polarity of the capacitor C1 reverses, the side of the capacitor C2 that is opposite that connected to the capacitor C1 has reversed polarity from that when the capacitor C2 was charged, and twice the voltage is generated.

Thereafter, when the time integral value of the voltage in the capacitor C2 reaches the specific value determined by the characteristics of the magnetic switch SR2, the magnetic switch SR2 saturates and turns ON. Then, current flows through the capacitor C2 →magnetic switch SR2→capacitor C3→capacitor C1→capacitor C2 loop, and the charge stored in the capacitors C1 and C2 is transferred to charge the capacitor C3.

After that, the magnetic switch SR3 saturates and turns on. Then, pulsed power with a short pulse width is applied between the first container 10*a* and the second container 10*b*—that is, between the first rotating electrode 1*a* and the second rotating electrode 1*b*—which constitute the load. Here, the inductance of a two-stage capacitance transfer circuit that comprises magnetic switch SR2→capacitor C1→capacitor C2 and magnetic switch SR3→capacitor C3 is set to grow smaller as it moves to the latter stage, by which means there is a pulse compression action such that the pulse width of the current pulse flowing in each stage gradually narrows, and power in short pulses is applied between the first main discharge electrode and the second main discharge electrode.

Now, a detailed illustration is omitted, but drive signals are sent from the controller 24 to the switches SW1, SW2. For example, in the event that switches SW1, SW2 are IGBTs, the drive signals sent from the controller 24 are input to each switch as gate signals. Further, a large current flows to the switch SW2, and so the switch SW2 can be constituted of multiple IGBTs connected in parallel.

Now, the charging switch SW1 described above is not necessarily an essential constituent element of the circuit. Nevertheless, the following effect can be obtained by adding a charging switch SW1. In the event that the charger CH is active and the charging switch SW1 is in the ON state, the charge in the capacitors C1, C2 moves in the following circuit loop. That is, the charge in the capacitor C1 moves in the circuit loop comprising charger→charging switch SW1→capacitor C1→charger. The charge in the capacitor C2, on the other hand, moves in the circuit loop comprising charger→charging switch S1→capacitor C2→magnetic switch SR2→magnetic switch SR3→inductor L→charger.

Therefore, by having the charging switch SW1 in the OFF state after charging is completed, the circuit loops described above will be in the open state and it will be possible to suppress the leakage of electrical energy stored in capacitors C1, C2. Further, by having the charging switch SW1 in the OFF state after charging is completed, no unwanted surge voltage, generated during the discharge between the first main discharge electrode and the second main discharge electrode, will be applied on the charger.

Figure 12:
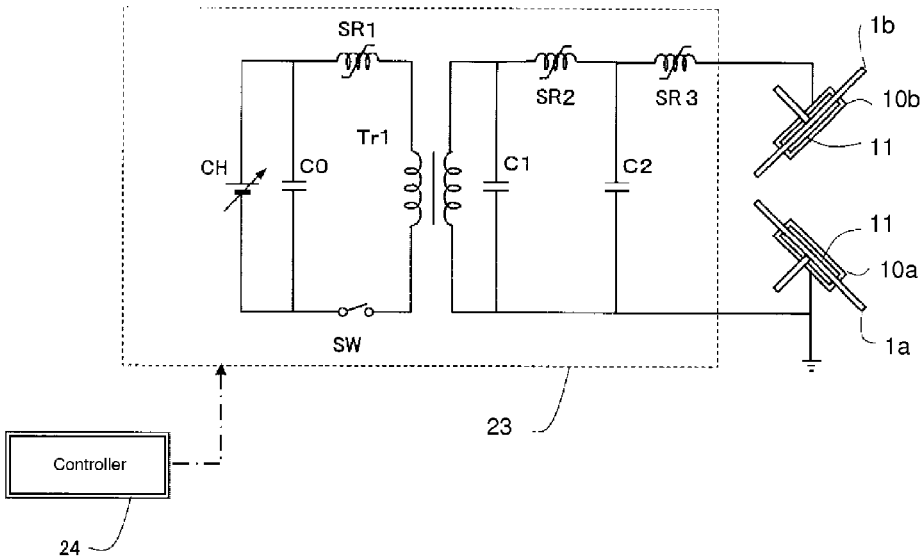
FIG. 12 shows an example of the constitution of a pulsed power generator in which the pulse transformer method is adopted.

FIG. 12 shows an example of the constitution of a pulsed power generator 23 in which the pulse transformer method is adopted. The pulsed power generator 23 shown in FIG. 12 has a two-stage magnetic pulse compression circuit that uses two magnetic switches SR2, SR3 that comprise saturable reactors. The magnetic switch SR1 is a magnetic assist.

The constitution and operation of the circuit are explained below in accordance with FIG. 12. First, the charging voltage from a charger CH is adjusted to a specified value (Vset), and the charger CH is in an active state. As a result, the capacitors C0 is charged to the specified voltage. The switch SW is OFF at this time. A solid-state switch that is a semiconductor switching element such as an IGBT, for example, is used as the charging switch SW. After the charging of the capacitor C0 is completed, the active state of the charger CH turns OFF. After that, the switch SW for the charger turns ON.

If there were no magnetic switch SR1, the voltage of the capacitor C0 would be applied to both terminals of the switch SW when the switch SW was turned ON. Because there is a magnetic switch SR1, however, the voltage of the capacitor C0 is applied primarily to the terminals of the magnetic switch SR1. Thereafter, the magnetic switch SR1 saturates and turns ON. The period from when voltage is applied on the magnetic switch SR1 until the magnetic switch SR1 is turned ON is the period until the switch SW is turned completely ON. That is, the magnetic switch SR1 holds voltage until the switch SW is completely ON.

When the magnetic switch turns on, current flows in the capacitor C0→magnetic switch SR1→primary side of step-up transformer Tr1→switch SW→capacitor C0 loop, and the charge stored in the capacitor C0 is transferred to charge the capacitor C1. Thereafter, when the time integral value of the voltage in the capacitor C1 reaches the specific value determined by the characteristics of the magnetic switch SR2, the magnetic switch SR2 saturates and turns ON. Then, current flows through the capacitor C1→magnetic switch SR2→capacitor C2→capacitor C1 loop, and the charge stored in the capacitor C1 is transferred to charge the capacitor C2.

After that, the magnetic switch SR2 saturates and turns on when the time integral value of the voltage in the capacitor C2 reaches the specific value determined by the characteristics of the magnetic switch SR3. Then pulsed power with a short pulse width is applied between the first container 10*a* and the second container 10*b*—that is, between the first rotating electrode 1*a* and the second rotating electrode 1*b*—which constitute the load.

Here, the inductance of a two-stage capacitance transfer circuit that comprises magnetic switch SR2→capacitor C1 and magnetic switch SR3→capacitor C2 is set to grow smaller as it moves to the latter stage, by which means there is a pulse compression action such that the pulse width of the current pulse flowing in each stage gradually narrows, and power in short pulses is applied between the first main discharge electrode and the second main discharge electrode.

A detailed illustration is omitted, but drive signals are sent from the controller 24 to the switch SW. For example, in the event that switch SW is an IGBT, the drive signals sent from the controller 24 are input to the switch as gate signals. Further, a large current flows to the switch SW, and so the switch SW can be constituted of multiple IGBTs connected in parallel.

As is described hereafter, an energy beam is radiated toward high-temperature plasma raw material. The high-temperature plasma raw material is gasified by the energy beam irradiation. When the gasified high-temperature plasma raw material reaches the discharge region and the gasified high-temperature plasma raw material in the discharge region has the specified gas density distribution, a short pulsed voltage is applied between the first main discharge electrode and the second main discharge electrode, by which means a discharge is generated between the edges on the periphery of the first rotating electrode 1*a* and the second rotating electrode 1*b*, and a plasma 4 is created. The plasma 4 is heated and excited by a large pulsed current flowing through the plasma 4, and when it reaches a high temperature, 13.5 nm wavelength EUV radiation is generated by the high-temperature plasma 4. Now, because the pulsed power is applied between the first and second rotating electrodes 1*a*, 1*b*, the discharge is a pulsed discharge and the EUV radiation is in pulsed form. A specific numerical example is shown below.

The performance of the high-voltage pulsed power generators shown in FIGS. 11 & 12 is determined by the energy conversion efficiency, which is the ratio of 13.5 nm wavelength EUV radiation energy to the input energy for high-temperature plasma, the reflectivity of the grazing incidence type EUV collector mirror 3 that is described hereafter, and the power at the focal point of the EUV radiation collected by the EUV collector mirror. For example, the power at the focal point of the EUV radiation collected by the EUV collector mirror described above is set at 115 W.

Considering these parameters, the performance of the high-voltage pulsed power generators shown in FIGS. 11 & 12 can be determined as, for example, capability to apply voltage from +20 kV to −20 kV between the first main discharge electrode and the second main discharge electrode, and to deliver energy of about 10 J/pulse or greater between the first main discharge electrode and the second main discharge electrode at a frequency of 7 kHz or higher. Further, the performance of the high-voltage pulsed power generators shown in FIGS. 11 & 12 can be determined as, for example, capability to apply voltage from +20 kV to −20 kV between the first main discharge electrode and the second main discharge electrode, and to deliver energy of about 4 J/pulse or greater between the first main discharge electrode and the second main discharge electrode at a frequency of 10 kHz or higher.

The high-temperature plasma raw material gasified by irradiation by the laser beam 5, as stated above, expands, centered on the direction of the normal line of the high-temperature plasma raw material surface struck by the laser beam 5. Therefore, it is necessary that the laser beam 5 irradiate the side of the high-temperature plasma raw material that faces the discharge region, so that the gasified high-temperature plasma raw material will expand in the direction of the discharge region. A carbon dioxide gas laser, a solid laser such as a YAG laser, a $YVO_4$ laser, a YLF laser, or an excimer laser such as a ArF laser, a KrF laser, or an XeCl laser can be adopted as the laser here. In this embodiment, a laser beam was used as the energy beam irradiating the high-temperature plasma raw material, but it is also possible to irradiate the high-temperature plasma raw material with an ion beam or electron beam instead of a laser beam.

Here, a part of the gasified high-temperature plasma raw material 2*a* supplied to the discharge region by means of laser beam 5 irradiation that is not involved in the formation of high-temperature plasma by the discharge, or a part of the cluster of atomic gas decomposed and produced as a result of plasma formation, contacts the low-temperature portion in the EUV light source device and accumulates as debris. For that reason, it is preferable to supply the high-temperature plasma raw material 2*a* and irradiate the high-temperature plasma raw material 2*a* in such a way that the gasified high-temperature plasma raw material does not expand in the direction of the EUV collector mirror 3.

Specifically, the drop position of the raw material supply means 2 is adjusted so that the high-temperature plasma raw material 2*a* is supplied to the space between the paired electrodes 1*a*, 1*b* and the EUV collector mirror 3, which is a space in the vicinity of the discharge region. Moreover, the laser 12 is adjusted so that the laser beam 5 irradiates the side of the high-temperature plasma raw material 2*a* that faces the discharge region, so that the gasified high-temperature plasma raw material will expand in the direction of the discharge region. By means of the above adjustments, it is possible to suppress the progress of debris toward the EUV collector mirror 3.

Now, the high-temperature plasma raw material 2*a* that is gasified by irradiation from the laser beam 5 expands, centered on the normal line of the surface of the high-temperature plasma raw material 2*a* that is hit by the laser beam 5, but to speak in greater detail, the density of the high-temperature plasma raw material that is gasified and dispersed will be highest in the direction of the normal line, and will decrease as the angle from the normal line increases. In consideration of the above, both the high-temperature plasma raw material supply position and the laser beam irradiation energy and other irradiation conditions must be set appropriately so that the space density distribution of the gasified high-temperature plasma raw material supplied to the discharge region will cause the EUV radiation to be collected efficiently after the high-temperature plasma raw material is heated and excited in the discharge space.

A raw material recovery means 14 to recover the high-temperature plasma raw material that was not gasified can be installed, as shown in FIG. 4, at the bottom of the space to which the high-temperature plasma raw material is supplied.

(3) EUV radiation focal portion: The EUV radiation emitted from the discharge portion is collected by a grazing incidence type EUV collector mirror 3 mounted in the EUV collector mirror portion, and is then guided from the EUV radiation extractor 9 mounted in the chamber 6 to the irradiation optical system of the lithography equipment, illustration of which has been omitted. This grazing incidence type EUV collector mirror 3 generally has a structure in which multiple thin, concave mirrors are arranged with high precision in a nested fashion. The shape of the reflecting surface of the concave mirrors is, for example, an ellipsoid of revolution, paraboloid of revolution, or Wolter-type mirror; the concave mirrors are bodies of revolution. A Wolter-type mirror has a concave shape in which the plane of incidence goes from a hyperboloid of revolution to an ellipsoid of revolution, or from a hyperboloid of revolution to a paraboloid of revolution.

The base material of these concave mirrors is, for example, nickel (Ni). Because it reflects EUV radiation with a very short wavelength, the reflecting surface of the concave mirror is constituted with very good smoothness. The reflecting material applied to this smooth surface is a metal film such as ruthenium (Ru), molybdenum (Mo), or rhodium (Rh). This metallic film on the reflecting surface of the concave mirror is a precision coating. By means of such a constitution, the EUV collector mirror 3 can reflect and collect EUV radiation with a grazing incidence angle from 0° to 25° well.

(4) Debris trap: Between the discharge portion (discharge space 6*a*) and the EUV collector mirror portion (collector mirror space 6*b*), there is a debris trap that has the purpose of trapping metal dust and other debris spattered from the edges of the first and second rotating electrodes 1*a*, 1*b* by the high-temperature plasma when the electrodes contacted the high-temperature plasma produced following discharge, or debris arising from Sn or Li that is the EUV radiation fuel in the high-temperature plasma raw material, and to allow only the EUV radiation to pass. As stated previously, in the EUV light source device of this invention shown in FIGS. 4 & 5, the debris trap comprises a gas curtain 13*a* and a foil trap 8.

Figure 6:
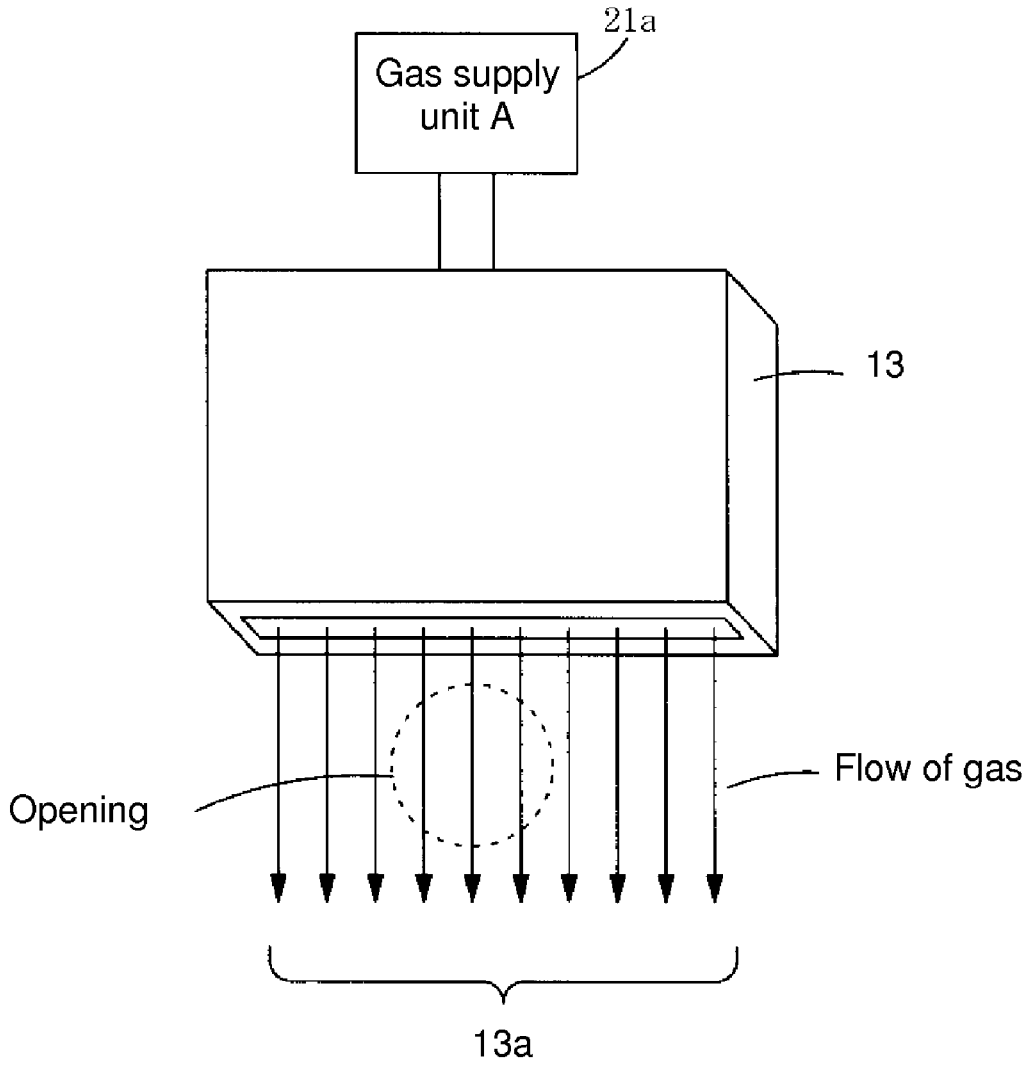
FIG. 6 is a diagram for explaining a gas curtain mechanism.

The gas curtain 13*a* is constituted by gas that is supplied from a gas supply unit 21*a* to the chamber 6 by way of a nozzle 13. FIG. 6 is a diagram to explain the gas curtain mechanism. The nozzle 13 is, for example, a rectangular parallelepiped, and the opening that releases the gas has a long, thin quadrilateral shape. When gas is supplied from the gas supply unit 21*a* to the nozzle 13, the gas is released in the form of a sheet from the opening of the nozzle 13 and forms the gas curtain 13*a*. The gas curtain 13*a* changes the direction in which the debris described above is progressing and keeps the debris from arriving at the EUV collector mirror 3. The gas used here in the gas curtain 13*a* is preferably a gas with high transparency to EUV radiation; hydrogen and such rare gases as helium and argon can be used.

A foil trap 8 is located between the gas curtain 13 and the EUV collector mirror 3. This foil trap 8 is of a type that is described in Japanese Patent Application Publication 2004-214656 and corresponding U.S. Patent Application Publication 2004/184014, for example. The foil trap 8 comprises multiple plates positioned in the radial direction of the high-temperature plasma generation region, so as not to block the EUV radiation emitted from the high-temperature plasma, and ring-shaped backing that supports the plates. When such a foil trap 8 is set up between the gas curtain 13 and the EUV collector mirror 3, pressure is increased between the high-temperature plasma and the foil trap 8. When the pressure increases, the density of the gas present there also increases, as do the collisions between gas atoms and debris. By means of repeated collisions, the debris loses kinetic energy. Accordingly, it is possible to decrease the energy with which debris collides with the EUV collector mirror 3, and to decrease damage to the EUV collector mirror 3.

A gas supply unit 21*b* can be connected to the collector mirror space 6*b* side of the chamber 6 to introduce a buffer gas that is not related to the generation of EUV radiation. The buffer gas supplied from the gas supply unit 21*b* passes through the foil trap 8 from the EUV collector mirror 3 side and is exhausted by the vacuum exhaust equipment 22*a* by way of the space between the foil trap 8 and the partition 6*c*. By means of such a flow of gas, the debris that is not captured by the foil trap 8 is kept from flowing to the EUV collector mirror 3 side, and the damage to the EUV collector mirror 3 from debris can be reduced.

In addition to the buffer gas, hydrogen radicals and halogen gases, such as chlorine, can be supplied to the collector mirror space 6*b* from the gas supply unit 21*b*. These gases function as cleaning gases that react with the debris accumulated on the EUV collector mirror 3 and remove the debris without removal of the debris trap. Therefore, it is possible to suppress the functional decline of reduced reflectivity of the EUV collector mirror 3 due to debris accumulation.

(5) Partition: Pressure in the discharge space 6 is set for good generation of discharge for heating and excitation of high-temperature plasma raw material that has been gasified by laser beam irradiation; it is necessary to maintain the pressure below a certain level. On the other hand, in the collector mirror space 6*b*, it is necessary to reduce the kinetic energy of debris in the debris trap, and so it is necessary to maintain a specified pressure in the debris trap portion. In FIGS. 4 & 5, the kinetic energy of debris is reduced by means of a specified gas flow from the gas curtain 13*a* and maintenance of a specified pressure at the foil trap. It is necessary, therefore, to maintain a reduced-pressure atmosphere in the collector mirror space 6*a* with a pressure of several hundred Pa.

Here, the EUV light source device of this invention has a partition 6*c* that divides the chamber 6 into the discharge space 6*a* and the collector mirror space 6*b*. There is an opening in the partition 6*c* that connects the two spaces 6*a*, 6*b* spatially. The opening functions as a pressure resistance, and so when the discharge space 6*a* is exhausted by the vacuum exhaust equipment 22*b* and the collector mirror space 6*b* is exhausted by the vacuum exhaust equipment 22*a*, it is possible to maintain the discharge space 6*a* and the collector mirror space 6*b* at the proper pressure by giving appropriate consideration to such things as the amount of gas flow from the gas curtain 13*a*, the size of the opening, and the exhaust capacity of the vacuum exhaust equipment.

(6) Operation of the extreme ultraviolet (EUV) light source device: In the event that the EUV light source device of this invention is used as a light source for lithography, it operates as follows, for example. The vacuum exhaust equipment 22*b* operates and the discharge space 6*a* is evacuated. On the other hand, as the vacuum exhaust equipment 22*a* operates, the gas supply unit 21 operates and forms the gas curtain 13*a*, and the gas supply unit 21*b* operates and supplies the collector mirror space 6*b* with buffer gas and cleaning gas. The specified pressure is achieved in the collector mirror space 6*b* as a result. The first rotating electrode 1*a* and the second rotating electrode 1*b* rotate. Following this standby status, the liquid or solid high-temperature plasma raw material 2*a* (such as tin in a liquid state) for EUV radiation is dripped from the raw material supply unit 2. At the point in time when the high-temperature plasma raw material 2*a* reaches the specified position in the vicinity of the discharge region within the discharge space, the high-temperature plasma raw material is irradiated by a laser beam 5 from the laser 12.

As stated above, the high-temperature plasma raw material 21 is supplied to a space between the paired rotating electrodes 1*a*, 1*b* and the EUV collector mirror 3, which is a space in the vicinity of the discharge region. Further, the laser beam 5 irradiates the side of the surface of the high-temperature plasma raw material that faces the discharge region. By this means, the gasified high-temperature plasma raw material does not expand in the direction of the EUV collector mirror 3, but expands in the direction of the discharge region.

The gasified high-temperature plasma raw material reaches the discharge region and the high-temperature plasma raw material that has been gasified attains the specified gas density distribution in the discharge region, at which point pulsed power of, for example, about +20 kV to −20 kV from the pulsed power generator 23 is applied to the first rotating electrode 1*a* and the second rotating electrode 1*b* by way of the first and second conductive containers 10*a*, 10*b* and the conductive metal melt for power supply 11.

When the pulsed power is applied, discharge is generated between the edges on the periphery of the first rotating electrode 1*a* and the second rotating electrode 1*b*, and a plasma 4 is formed. When the pulsed large current that flows through the plasma 4 heats and excites the plasma 4 to a high temperature, 13.5 nm wavelength EUV radiation is generated from the high-temperature plasma. Now, because pulsed power is applied between the first and second rotating electrodes 1*a*, 1*b*, the discharge is a pulsed discharge, and the EUV radiation is pulsed. The EUV radiation emitted by the plasma 4 passes through an opening in the partition 6*c* and the foil trap 8, and is collected by the grazing incidence type EUV collector mirror 3 located in the collector mirror space 6*b*; it is guided from the EUV collector installed in the chamber 6 to the irradiation optical system of the lithography equipment, illustration of which has been omitted.

The action of the EUV light source device described above is performed under the control of a controller 24 that receives EUV generation commands from the controller 25 of the lithography equipment. That is, the controller 24 controls the action of the gas supply unit 22*a*, the gas supply unit 22*b*, the vacuum exhaust equipment 22*a*, the vacuum exhaust equipment 22*b*, the pulsed power generator 23, the laser 12, the first motor 1*e*, the second motor 1*f*, and the raw material supply means.

It is also all right to install magnets 7 in the vicinity of the discharge region that generates the plasma 4, and create a magnetic field with respect to the plasma 4, as shown in FIG. 5. In the EUV light source device of this invention, as stated above, the high-temperature plasma raw material 2*a* is supplied to a space in the vicinity of the discharge region in the discharge space where there is a vacuum atmosphere, a laser beam is radiated toward the high-temperature plasma raw material 2*a* that is supplied and gasifies the high-temperature plasma raw material, and the gasified high-temperature plasma raw material is supplied to the discharge region. When the gasified gas is supplied to the discharge region, a discharge is generated and produces plasma 4 that emits EUV radiation. The plasma 4 generated in this way is thought to disperse and disappear because of the density gradient of the particles of the gasified high-temperature plasma raw material in the discharge region. In other words, the plasma size is thought to enlarge because the plasma disperses.

Here, we will consider the case of installing magnets 7 as shown in FIG. 5 and applying a uniform magnetic field roughly parallel to the direction of discharge generated between the first and second rotating electrodes 1*a*, 1*b*. Charged particles in the uniform magnetic field are subject to a Lorentz force. The Lorentz force acts in a direction perpendicular to the magnetic field, so the charged particles engage in uniform circular motion in a plane perpendicular to the magnetic field. Therefore, the motion of the charged particles becomes a motion compounded with the above; the particles move helically, with a fixed pitch, along the magnetic field (in the direction of the magnetic field).

Therefore, it is hypothesized that when a uniform magnetic field is applied roughly parallel to the direction of discharge generated between the first and second rotating electrodes 1*a*, 1*b*, it is possible to reduce the amount of plasma dispersion if the turning radius of the charged particles moving helically around the lines of magnetic force is made small enough by application of the magnetic field. In other words, it is thought that, compared with the case in which no magnetic field is applied, plasma size can be reduced and collection efficiency can be raised (blurred focus can be minimized). Further, it is thought that the plasma longevity can be preserved for a longer period than required to disperse and disappear, so it is thought that when the magnetic field is applied as described above, it is possible to emit EUV longer than when no magnetic field is applied.

By applying a magnetic field as described above, it is possible to reduce the size of the high-temperature plasma that radiates EUV (in other words, the size of the EUV light source), and it is possible to lengthen the EUV radiation time. Further, if the turning radius of the charged particles described above is enough smaller than the shortest distance from the position of plasma production to the EUV collector mirror, that part of the debris arising from high-temperature plasma raw material that is high-speed ion debris will not reach the collector mirror because of helical motion at that turning radius. In other words, it can be presumed that by applying a magnetic field, it is possible to reduce the amount of scatter of ion debris.

The action and effects of the first embodiment of this invention, explained above, are summarized below.

(a) In the EUV light source device of this invention, a liquid or solid high-temperature plasma raw material used to emit EUV is not supplied to the surface of the discharge electrodes, but is supplied to the vicinity of the discharge region (a space other than the discharge region, from which the gasified raw material can reach the discharge region), and the high-temperature plasma raw material is irradiated with a laser beam. For that reason, the laser beam does not irradiate the electrodes directly, so it is possible to achieve the effect of avoiding wear of the electrodes due to laser ablation.

(b) The high-temperature plasma raw material gasified by laser beam irradiation expands centered on the normal line of the high-temperature plasma raw material struck by the laser beam.

Therefore, in this invention, the laser beam irradiates the surface of the high-temperature plasma raw material on the side that faces the discharge region, so that the gasified high-temperature plasma raw material will expand in the direction of the discharge region. A part of the gasified high-temperature plasma raw material supplied to the discharge region by means of laser beam irradiation that is not involved in the formation of high-temperature plasma by the discharge, or a part of the cluster of atomic gas decomposed and produced as a result of plasma formation, contacts the low-temperature portion in the EUV light source device and accumulates as debris.

As a result, it is preferable that the high-temperature plasma raw material 2*a* be supplied to a space between the paired electrodes 1*a*, 1*b* and the EUV collector mirror 3, which is a space in the vicinity of the discharge region. When the high-temperature plasma raw material supplied in that way is irradiated by the laser beam on the side of the surface of the high-temperature plasma raw material that faces the discharge region, the gasified high-temperature plasma raw material expands in the direction of the discharge region and does not expand in the direction of the EUV collector mirror 3. By means of supplying the high-temperature plasma raw material and setting the irradiation position of the laser beam as above, it is possible to suppress the progress of debris toward the EUV collector mirror 3.

Now, when the paired electrodes 1*a*, 1*b* are columnar as shown in FIG. 3, the gasified high-temperature plasma raw material will not spread in the direction of the EUV collector mirror 3 if the high-temperature plasma raw material is supplied to the vicinity of the discharge region in a space on the plane perpendicular to the optical axis and the laser beam 5 irradiates the high-temperature plasma raw material from a direction perpendicular to the optical axis. Therefore, there will be almost no debris released toward the EUV collector mirror 3 as a result of laser beam irradiation of the high-temperature plasma raw material or discharge generated between electrodes 1*a*, 1*b*.

(c) It can be presumed that it is possible to reduce the amount of high-temperature plasma dispersion by installing magnets 7 as shown in FIG. 5 and applying a magnetic field, roughly parallel to the direction of discharge generated between the first and second discharge electrodes 1*a*, 1*b* so that the turning radius of the charged particles that move helically around the lines of magnetic force is small enough. In other words, it is thought that, compared with the case in which no magnetic field is applied, plasma size can be reduced and collection efficiency can be raised. Further, it is thought that the plasma longevity can be preserved for a longer period than required to disperse and disappear, so it is thought that when the magnetic field is applied as described above, it is possible to emit EUV longer than when no magnetic field is applied.

That is, by applying a magnetic field as described above, it is possible to reduce the size of the high-temperature plasma that emits EUV (in other words, the size of the EUV light source), and it is possible to lengthen the EUV radiation time. Further, if the turning radius of the charged particles described above is enough smaller than the shortest distance from the position of plasma production to the EUV collector mirror, that part of the debris arising from high-temperature plasma raw material that is high-speed ion debris will not reach the collector mirror because of helical motion at that turning radius. In other words, it can be presumed that by applying a magnetic field, it is possible to reduce the amount of scatter of ion debris.

(d) While the raw material supply direction of high-temperature plasma raw material 2*a* supplied by the raw material supply means is not restricted, positioning of the plasma raw material recovery means 14 that recovers the high-temperature plasma raw material that has not been gasified is simpler if the high-temperature plasma raw material 2*a* is supplied in the form of droplets in the direction of the pull of gravity. For example, consider the case in which the raw material supply direction of high-temperature plasma raw material 2*a* supplied by the raw material supply means is horizontal with respect to the pull of gravity. The recovery position for the high-temperature plasma raw material that has not been gasified will depend on the state in which the high-temperature plasma raw material released from the raw material supply means is released. In the event that the release state changes, the recovery position would also change. Therefore, in this case, the plasma raw material recovery means would have to be a complex mechanism that could be installed wherever desired.

On the other hand, if the high-temperature plasma raw material 2*a* is supplied in the form of droplets in the direction of the pull of gravity, as in this embodiment, the raw material supply direction will remain the same even if there is a change in the state of release of the high-temperature plasma raw material 2*a* released by the raw material supply means 2. Therefore, once the plasma raw material recovery means is installed in the specified position, there is no real need to adjust the position of installation. In other words, the installation position of the plasma raw material recovery means is simplified in this case. Further, by supplying the high-temperature plasma raw material 2*a* in the form of droplets in the direction of the pull of gravity, a separate means of releasing the high-temperature plasma raw material becomes unnecessary, and the mechanism of the raw material supply means 2 is simplified.

(e) The structure of the electrodes can be chosen as desired in the EUV light source device of this invention, but it is preferable that the first discharge electrode 1*a* and second discharge electrode 1*b* be disk-shaped in shape and rotate, at least during discharge, as in this embodiment. With conventional fixed discharge electrodes, gradual wear occurs and the shape of the discharge electrodes changes as the cumulative number of discharges increases. Because of that, the discharge generated between the discharge electrodes gradually becomes unstable, and generation of EUV radiation also becomes unstable as a result. When the EUV light source device of this invention is used as the light source for mass-production semiconductor lithography equipment, it is necessary to suppress that sort of discharge electrode wear as much as possible and to lengthen the service life of the discharge electrodes.

Thus, as stated above, if the first discharge electrode 1*a* and the second discharge electrode 1*b* rotate, at least during discharge, the position on the two electrodes where the pulsed discharge is generated changes with each pulse. Accordingly, the thermal load borne by the first and second discharge electrodes 1*a*, 1*b* is smaller, the speed of discharge electrode wear is reduced, and it is possible to lengthen the service life of the discharge electrodes.

Now, when the first and second discharge electrodes 1*a*, 1*b* are constituted as rotating electrodes, it is preferable to position them with the edges on the periphery where the electrical field is concentrated during power application facing each other across a specified gap so that the discharge is more easily generated. In other words, it is preferable that the planes including the front surfaces of the electrodes 1*a*, 1*b* intersect as shown in FIG. 5. When they are positioned in that way, the most discharge will be generated where the gap between the edges on the periphery of the two electrodes is smallest, and the discharge position will be stable.

2. Example of a Modification of the First Embodiment

Figure 7:
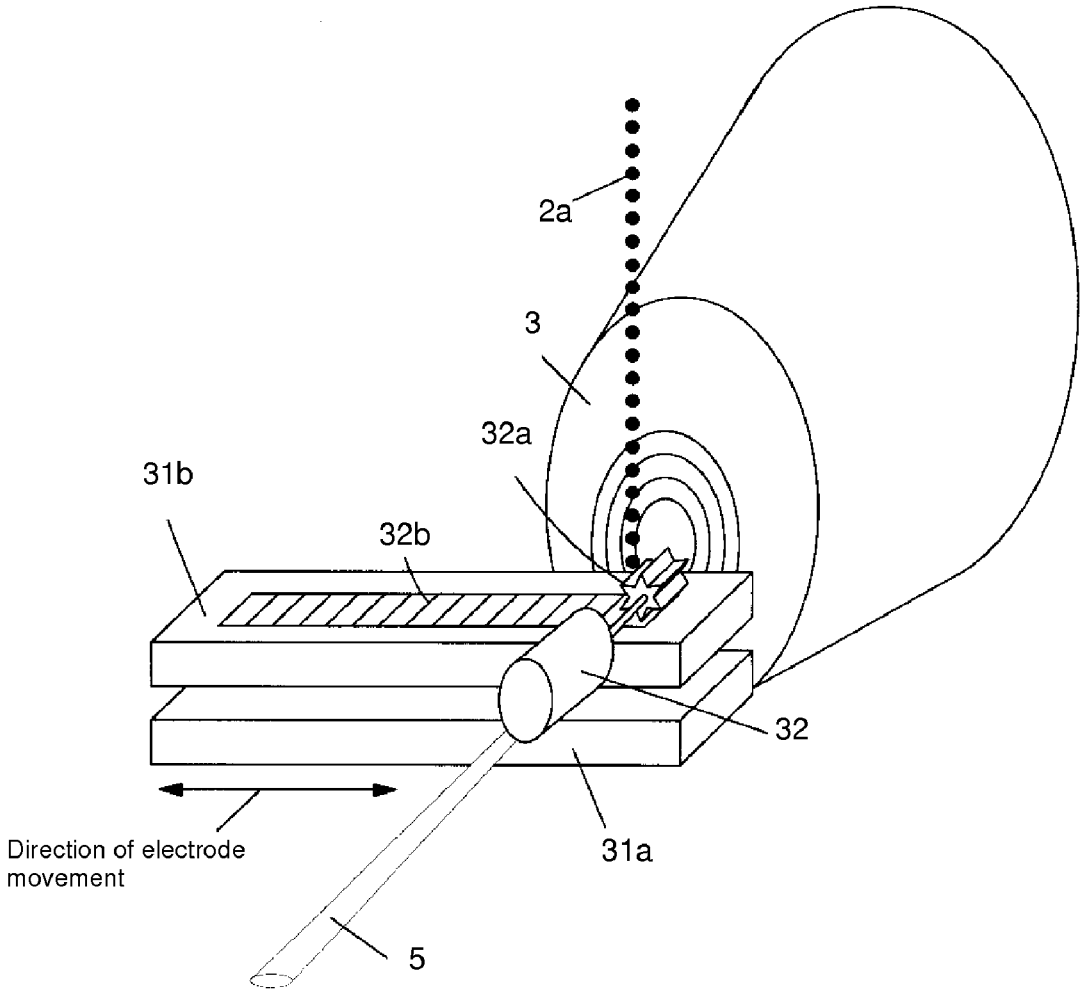
FIG. 7 is a conceptual perspective view for explaining an arrangement with which the first and second discharge electrodes are move back and forth.

The EUV light source device of this invention is not limited to the constitution of the first embodiment shown in FIGS. 4 & 5; various alterations are possible. For example, the discharge electrodes can be constituted to make a straight-line reciprocating movement, as shown in FIG. 7, rather than rotating. In FIG. 7, the first and second discharge electrodes 31*a*, 31*b* have, for example, the shape of rectangular plates and face each other across a specified gap. Specifically, the two electrodes are constituted as a single unit, sandwiching an insulating material (not illustrated). The two electrodes, constituted as a single unit, are driven by an electrode drive means 32 that comprises, for example, a stepping motor with a shaft-end gear 32*a* attached. On the upper surface of the second discharge electrode 31*b*, there is a gear rack 32*b* that engages the gear 32*a* of the electrode drive means 32. That is, the first and second discharge electrodes 31*a*, 31*b* can be given a straight-line reciprocating movement by means of repeated forward and reverse movement in the rotation of the stepping motor that is the electrode drive means 32.

With such a constitution of the first and second discharge electrodes 31*a*, 31*b*, the position in which pulsed discharge is generated between the two electrodes changes with each pulse. Therefore, the thermal load borne by the first and second discharge electrodes 31*a*, 31*b* is small, the speed of wear of the discharge electrodes is reduced, and the service life of the discharge electrodes can be prolonged. Now, in the event that the discharge electrodes are constituted to make the straight-line reciprocating motion shown in FIG. 7, the movement of the two discharge electrodes stops when the direction of movement is reversed. For that reason, the thermal load of discharge due to discharge may increase in the positions where the direction of movement is reversed. With the rotating electrode structure shown in the first embodiment, the two electrodes do not stop if the speed of rotation and direction of rotation are constant. Accordingly, the application of thermal load is more standard than with the electrodes constituted to make the straight-line reciprocating motion shown in FIG. 7.

Now, in the EUV light source device of the first embodiment shown in FIGS. 4 & 5, the position to which the high-temperature plasma raw material 2*a* is supplied is on the optical axis of the EUV collector mirror 3, and the direction of laser beam 5 irradiation that irradiates the high-temperature plasma raw material 2*b* matches that optical axis. However, the position to which the high-temperature plasma raw material 2*a* is supplied does not necessarily have to be on the optical axis of the EUV collector mirror 3, and the direction of laser beam 5 irradiation need not match that optical axis. Further, in the EUV light source device of the first embodiment shown in FIGS. 4 & 5, in the event of slippage in the alignment of the irradiation position of the laser beam and the high-temperature plasma raw material position, the laser beam 5 might irradiate the EUV collector mirror 3 and, depending on circumstances, there is a possibility of damage to the EUV collector mirror 3. Thus, in the event that it is necessary to keep a laser beam 5 from hitting the EUV collector mirror 3 during faulty radiation of the laser beam 5, the direction of the laser beam 5 can be adjusted as shown in FIG. 2(*a*) so that it does not hit the EUV collector mirror 3.

3. Second Embodiment

Figure 8:
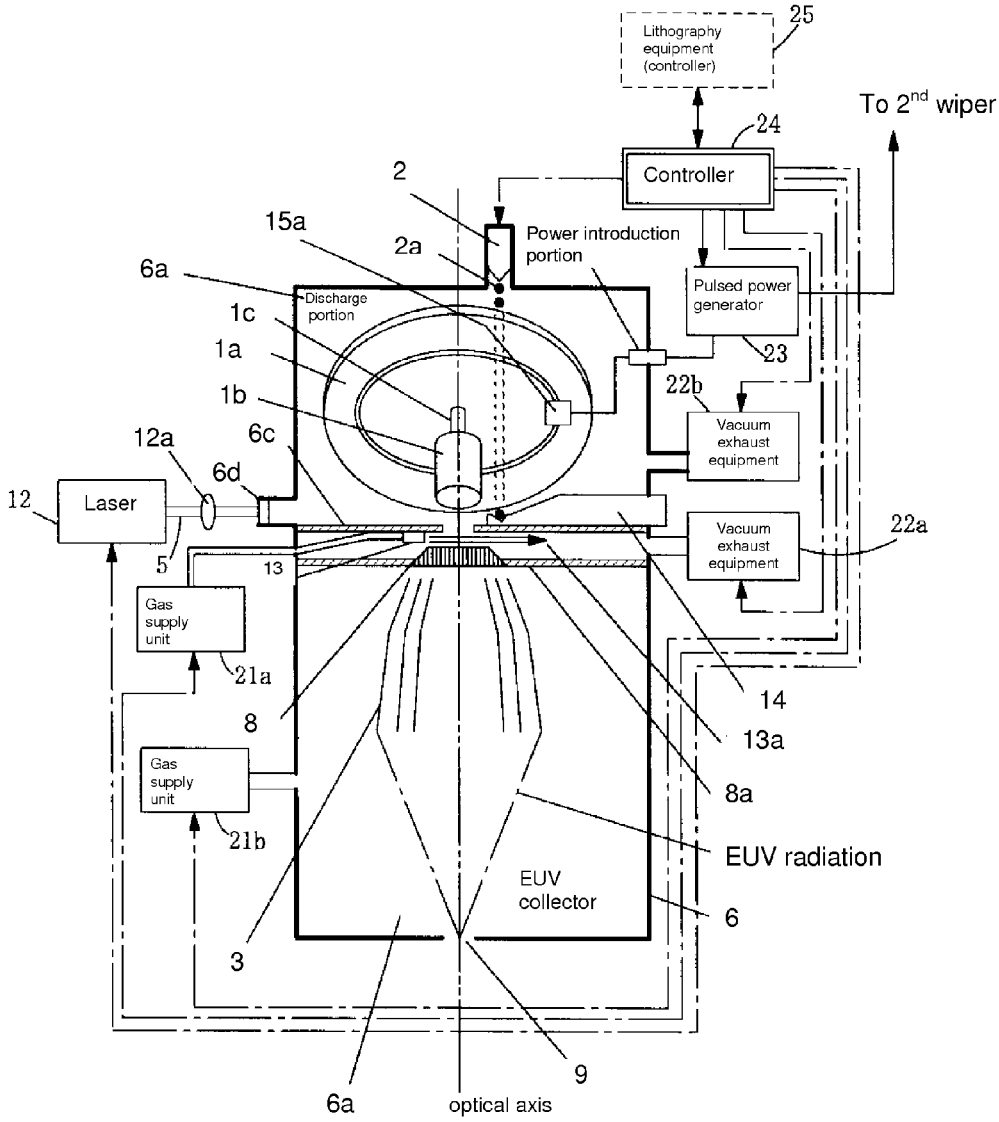
FIG. 8 is a block diagram (front view) of a second embodiment of the EUV light source device of this invention.
Figure 9:
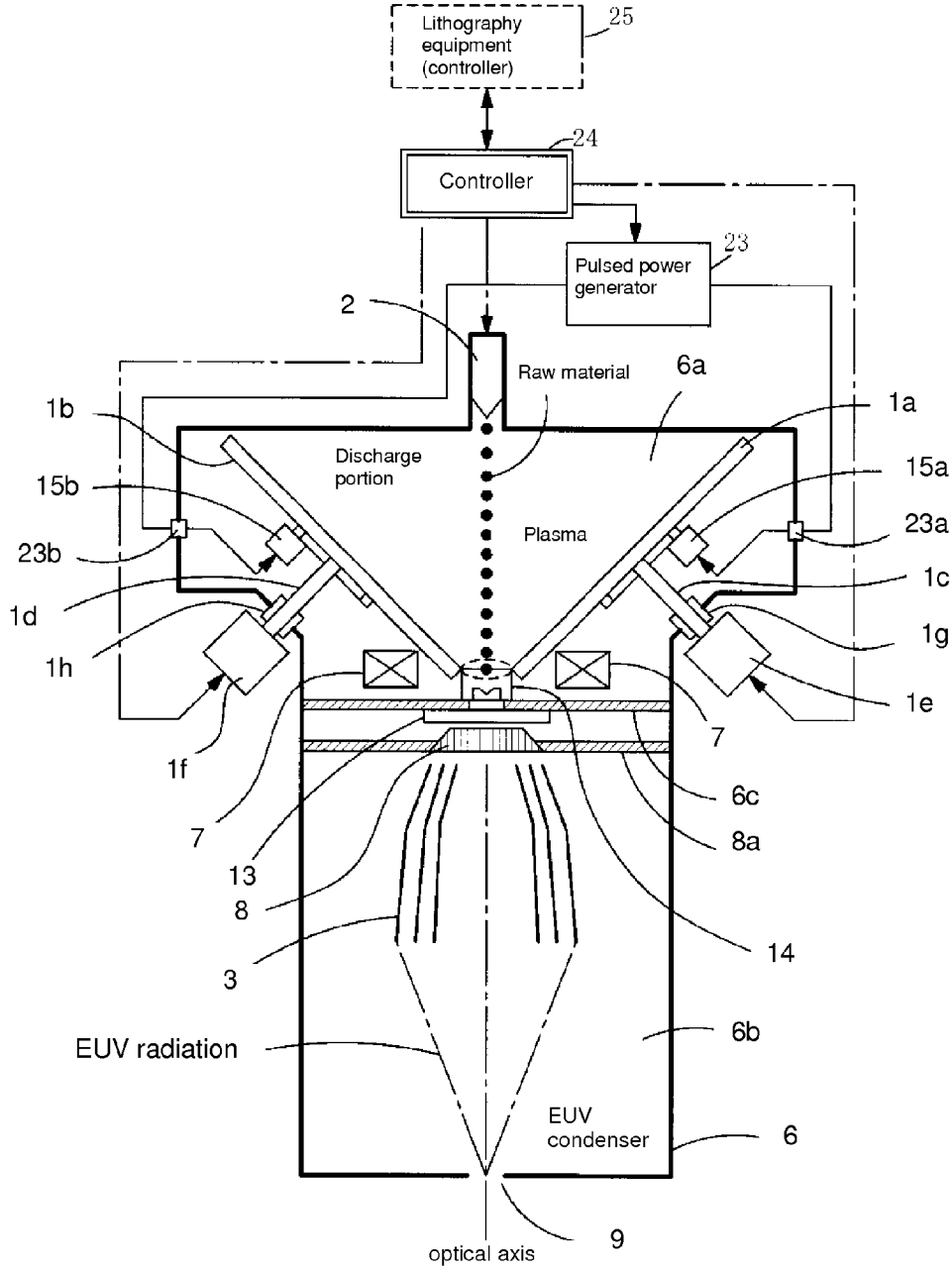
FIG. 9 is a block diagram (side view) of the second embodiment of the EUV light source device of this invention.
Figure 10:
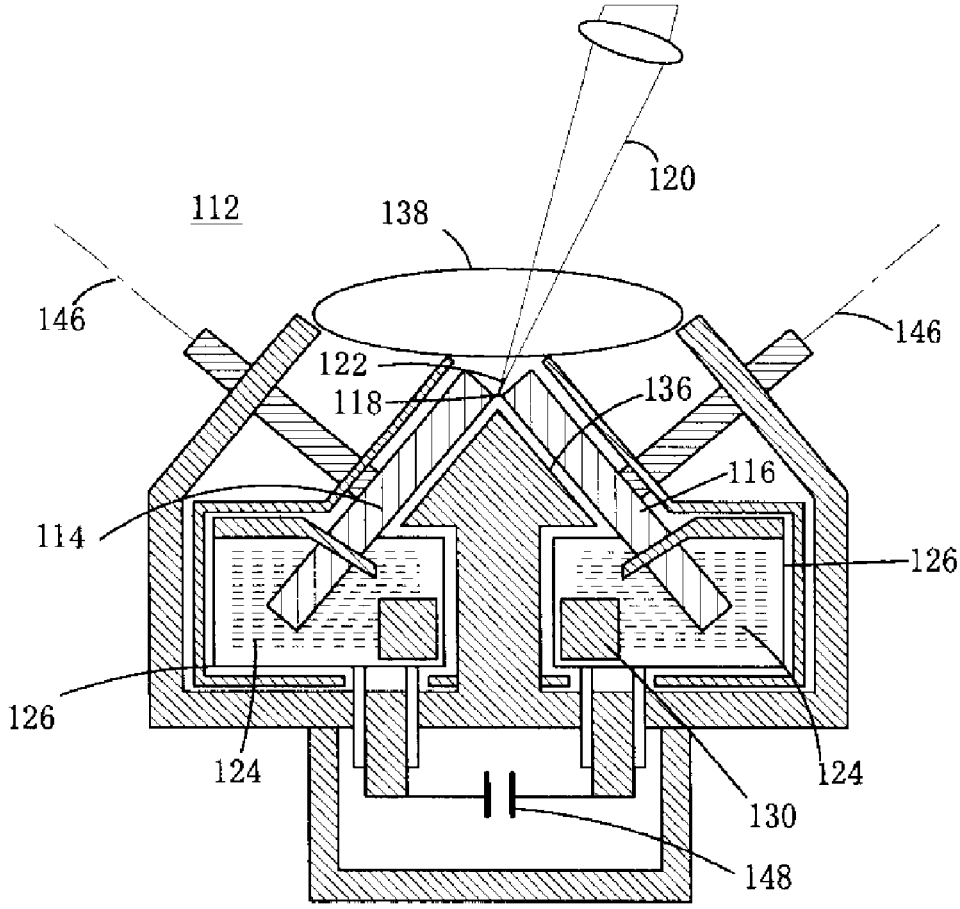
Fig. 10 (Prior Art)
FIG. 10 is a diagram showing an example of the constitution of conventional DPP-type EUV light source device.

FIGS. 8 & 9 show block diagrams (cross-sectional views) of the second embodiment of the EUV light source device of this invention. FIG. 8 is a front view of the second embodiment of the EUV light source device of this invention, and FIG. 9 is a side view of the second embodiment of the EUV light source device of this invention. The EUV light source device of the second embodiment, like the EUV light source device of the first embodiment that collects EUV radiation from the side, is constituted so that liquid or solid high-temperature plasma raw material that emits EUV is not supplied to the surface of the discharge electrodes, but to the vicinity of the discharge region, and a laser beam irradiates this high-temperature plasma raw material. By adoption of such a constitution, it is possible to achieve the effect of avoiding wear to the electrodes by laser abrasion, since the laser beam does not irradiate the electrodes directly.

The basic constitution of the EUV light source device of the second embodiment shown in FIGS. 8 & 9, like the light source device of the first embodiment, comprises a discharge portion, raw material supply and raw material gasification mechanisms, an EUV collector mirror portion, a debris trap, a partition, a controller, and so on, and the operation of the EUV light source device is also the same. With regard to the discharge portion and the raw material supply and raw material gasification mechanisms, the EUV radiation is collected from below, and so there are some differences in the constitution from the discharge portion and the raw material supply and raw material gasification mechanisms of the EUV light source device of the first embodiment. These differences are explained below, but explanation of the EUV collector mirror portion, the debris trap, partition, and controller, which are the same, is omitted. Further, the operation and effects of the EUV light source device of the second embodiment are the same as the operation and effects of the EUV light source device of the first embodiment, so explanation is omitted.

(1) Discharge portion: Like the EUV light source device of the first embodiment, the discharge portion is constituted of a first rotating electrode 1*a* and a second rotating electrode 1*b*. The two electrodes 1*a*, 1*b* are positioned with the edges at the periphery where the electrical field is concentrated when the power is applied facing each other across a specified gap so that the discharge is more easily generated. That is, the electrodes are positioned so that the hypothetical planes containing the surface of each electrode intersect. Now, the gap between the edges at the periphery of the two electrodes is the shortest length for the specified gap mentioned above. The first rotating electrode 1*a* and the second rotating electrode 1*b* are positioned for discharge centering on the line where, as viewed from the side as in FIG. 9, the hypothetical planes that include the surfaces of the first and second discharge electrodes 1*a*, 1*b* intersect. As shown in FIG. 9, the portion where the gap between the edges on the periphery of the two electrodes 1*a*, 1*b* is longest, is located on the opposite side from the EUV collector mirror 3 with respect to the intersection of the hypothetical planes mentioned above. In other words, the portion where the gap between the edges on the periphery of the two electrodes is longest is positioned to be above the shortest part.

It is also possible here to have the portion where the gap between the edges on the periphery of the two electrodes 1*a*, 1*b*, when positioned for discharge, located on the same side as the EUV collector mirror 3 when centered on the intersection of the hypothetical planes mentioned above. In that case, however, the distance from the discharge region to the EUV collector mirror 3 is lengthened; the EUV collection efficiency will decrease to that extent, so it is not practical.

A rotating shaft 1*c* of a first motor 1*e* and a rotating shaft 1*d* of a second motor 1*f* are attached at roughly the center portions of the disk-shaped first rotating electrode 1*a* and the second rotating electrode 1*b*, respectively. The first motor 1*e* and the second motor 1*f* rotate the rotating shafts 1*c*, 1*d*, and thus, rotate the first rotating electrode 1*a* and the second rotating electrode 1*b*. The direction of rotation is not particularly prescribed. Here, the rotating shafts 1*c*, 1*d* are introduced into the chamber 6 through mechanical seals 1*g*, 1*h*. The mechanical seals 1*g*, 1*h* allow rotation of the rotating shafts 1*c*, 1*d*, while maintaining the reduced-pressure air tightness of the chamber 6.

As stated above, the portion where the gap between the edges on the periphery of the two electrodes 1*a*, 1*b* is longest is positioned to be above the shortest part. Therefore, if the mechanism that supplies power to the electrodes 1*a*, 1*b* is constituted as conductive containers 10*a*, 10*b* that hold a conductive metal melt for power supply 11, as in the first embodiment, the containers would be located in the discharge portion. Therefore, it is not possible to adopt conductive containers that hold a conductive metal melt for power supply as the power supply mechanism. Therefore, in the EUV light source device of the second embodiment, the mechanism that supplies power to the electrodes is constituted as wipers 1*a*, 1*b*. As shown in FIG. 9, a first wiper 15*a* and a second wiper 15*b*, comprised of carbon brushes, for example, are mounted at the lower parts of the first rotating electrode 1*a* and the second rotating electrode 1*b* respectively.

The first wiper 15*a* and the second wiper 15*b* are electrical points of contact that maintain an electrical connection as they wipe. The wipers 15*a*, 15*b* are connected to a pulsed power generator 23 through an insulated power introduction portion 23*a* that can maintain the reduced-pressure air tightness of the chamber 6. The pulsed power generator 23 supplies pulsed power between the first rotating electrode 1*a* and the second rotating electrode 1*b* by way of the first wiper 15*a* and the second wiper 15*b*. That is, pulsed power from the pulsed power generator 23 is applied between the first rotating electrode 1*a* and the second rotating electrode 1*b*, by way of the first wiper 15*a* and the second wiper 15*b* even when the first motor 1*e* and the second motor 1*f* are operating and the first rotating electrode 1*a* and the second rotating electrode 1*b* are rotating.

(2) Raw material supply and raw material gasification mechanisms: A high-temperature plasma raw material 2*a* to emit extreme ultraviolet radiation is supplied by a raw material supply means 2 mounted in the chamber 6, in liquid or solid form, to the vicinity of the discharge region (a space between the edge on the periphery of the first rotating electrode 1*a* and the edge on the periphery of the second rotating electrode 1*b*, where a discharge is generated). The raw material supply means 2 is located on the top wall of the chamber 6, and the high-temperature plasma raw material 2*a* is supplied (dripped) in droplet form to the space in the vicinity of the discharge region. When the high-temperature plasma raw material 2*a* that is supplied in droplet form is dripped down and arrives at the space in the vicinity of the discharge region, it is irradiated and gasified by a laser beam 5 emitted by a laser 12.

The laser beam 5 is condensed by a condenser lens or other condensed optical system 12*a*, passes through the aperture 6*d* of the chamber 6, and is concentrated as a condensed laser beam on the high-temperature plasma raw material 2*a*. Now, the high-temperature plasma raw material gasified by irradiation by the laser beam 5, as stated above, expands, centered on the direction of the normal line of the high-temperature plasma raw material surface struck by the laser beam 5. Therefore, it is necessary that the laser beam 5 irradiate the side of the high-temperature plasma raw material that faces the discharge region, so that the gasified high-temperature plasma raw material will expand in the direction of the discharge region.

Here, a part of the gasified high-temperature plasma raw material to the discharge region by means of laser beam 5 irradiation that is not involved in the formation of high-temperature plasma by the discharge, or a part of the cluster of atomic gas decomposed and produced as a result of plasma formation, contacts the low-temperature portion in the EUV light source device and accumulates as debris. For that reason, it is preferable to supply the high-temperature plasma raw material 2*a* and irradiate the high-temperature plasma raw material 2*a* in such a way that the gasified high-temperature plasma raw material does not expand in the direction of the EUV collector mirror 3.

Specifically, the drop position of the raw material supply means 2 is adjusted so that the high-temperature plasma raw material 2*a* is supplied to the space between the paired electrodes 1*a*, 1*b* and the EUV collector mirror 3, which is a space in the vicinity of the discharge region. Moreover, the laser 12 is adjusted so that the laser beam 5 irradiates the side of the high-temperature plasma raw material 2*a* that faces the discharge region, so that the gasified high-temperature plasma raw material will expand in the direction of the discharge region. By means of the above adjustments, it is possible to suppress the progress of debris toward the EUV collector mirror 3.

Now, the high-temperature plasma raw material that is gasified by irradiation from the laser beam 5 expands, centered on the normal line of the surface of the high-temperature plasma raw material 2*a* that is hit by the laser beam 5, but to speak in greater detail, the density of the high-temperature plasma raw material that is gasified and dispersed will be highest in the direction of the normal line, and will decrease as the angle from the normal line increases. In consideration of the above, both the high-temperature plasma raw material supply position and the laser beam irradiation energy and other irradiation conditions must be set appropriately so that the space density distribution of the gasified high-temperature plasma raw material supplied to the discharge region will cause the EUV radiation to be collected efficiently after the high-temperature plasma raw material is heated and excited in the discharge space.

As in the case of the EUV light source device of the first embodiment in which EUV radiation is collected from the side, the following two problems occur when the position of the high-temperature plasma raw material that is irradiated and gasified by the laser beam is set on the optical axis. The first problem is that the high-temperature plasma raw material that is dripped in droplet form passes through the discharge region, which is also the EUV radiation generation region.

In the event that the high-temperature plasma raw material is supplied continuously in the form of droplets, when the high-temperature plasma raw material in the form of droplets passes through the discharge region, it is liable to be decomposed and gasified by the previous discharge before it can be gasified by laser beam irradiation. Further, the course of the high-temperature plasma raw material in droplet form will be changed by the impact of the previous discharge. Thus, there is the problem that high-temperature plasma raw material in the form of droplets cannot be stably supplied to the site of laser irradiation.

The second problem is that the high-temperature plasma raw material in droplet form that is not used in the discharge enters the collector mirror space where the EUV collector mirror is located, and so the raw material recovery means must be located prior to the EUV collector mirror in the collector mirror space. There is hardly any space in the collector mirror space to locate the raw material recovery means prior to the EUV collector mirror, and if it is put there, it will interfere with the EUV radiation and reduce the amount of EUV radiation collected by the EUV collector mirror. Further, when the high-temperature plasma raw material in droplet form passes through the space where the EUV collector mirror is located, a part of it will be gasified, and this gasified raw material will contaminate the EUV collector mirror 3.

In consideration of these two problems, a constitution like that in FIGS. 8 & 9, in which the drop axis of the high-temperature plasma raw material in droplet form does not match the optical axis of the EUV collector mirror 3 is desirable, as is placement of the raw material recovery means 14 in a region through which the EUV radiation does not pass, as close as possible to the position of gasification by the laser beam 5. In the event that the discharge space 6*a* and the collector mirror space 6*b* of the chamber 6 are completely separate and there is a discharge chamber that houses the discharge portion and a collector mirror chamber that houses the collector mirror portion, it is desirable that the raw material recovery means be located in the discharge chamber.

What is claimed is:

1. Extreme ultraviolet light source device, comprising:

a vessel, a raw material supply means for supplying a liquid or solid raw material to the vessel for radiation of extreme ultraviolet radiation, an energy beam radiation means for generating an energy beam for irradiating the raw material and gasifying the raw material, a pair of discharge electrodes separated by a gap for high-temperature excitation of the gasified raw material and generation of a high-temperature plasma by means of electrical discharge in the vessel, a pulsed power supply means for supplying pulsed power to the discharge electrodes, a collector optical means for collecting extreme ultraviolet radiation emitted by the high-temperature plasma produced in a discharge region produced by the pair of discharge electrodes, and an extreme ultraviolet radiation extractor that extracts the collected extreme ultraviolet radiation, wherein the energy beam irradiation means is positioned so as to irradiate the energy beam on raw material supplied to a space other than the discharge region, from which the gasified raw material can reach the discharge region.

2. Extreme ultraviolet light source device as described in claim 1, wherein the raw material supply means is adapted to supply the raw material to a space between the discharge region and the collector optical means, and wherein the energy beam irradiation means is adapted to set the energy beam irradiation position in a region on the surface of the raw material where the raw material faces the discharge region.

3. Extreme ultraviolet light source device as described in claim 1, wherein the raw material supply means is adapted to supply the raw material in a plane that is perpendicular to the optical axis of the collector optical means and includes the center of the discharge region, and wherein the energy beam irradiation means is adapted to set the energy beam irradiation position in a region on the surface of the raw material where the raw material faces the discharge region.

4. Extreme ultraviolet light source device as described in claim 1, further comprising a magnetic field application means for applying a magnetic field on the discharge region that is roughly parallel to a direction of the discharge produced between the pair of discharge electrodes.

5. Extreme ultraviolet light source device as described in claim 1, wherein the raw material supply means is operative for dripping the raw material in the form of droplets in a direction of gravity.

6. Extreme ultraviolet light source device as described in claim 1, wherein the energy beam is a laser beam.

7. Extreme ultraviolet light source device as described in claim 1, further comprising a discharge electrode drive by which the pair of discharge electrodes is driven so as to change the position of discharge generation on the electrode surface.

8. Extreme ultraviolet light source device as described in claim 7, wherein the paired discharge electrodes are disk-shaped electrodes and the discharge electrode drive is a rotary drive.

9. Extreme ultraviolet light source device as described in claim 8, in which the paired, disk-shaped discharge electrodes face each other with outer edges thereof separated by a specified gap.

10. Extreme ultraviolet light source device as described in claim 1, wherein the pulsed power supply means has a frequency of at least 7 kHz and is adapted to supply at least 10 J/pulse of pulsed power.

11. Extreme ultraviolet light source device as described in claim 1, wherein the pulsed power supply means described above is constituted to have a frequency of at least 10 kHz and to supply at least 4 J/pulse of pulsed power.

12. A method of generating extreme ultraviolet radiation, comprising the steps of:

irradiating a supply of liquid or solid raw material for extreme ultraviolet radiation with an energy beam and gasifying the raw material, and heat-exciting the gasified raw material by discharge to produce a high-temperature plasma and to generate extreme ultraviolet radiation, and wherein the raw material is supplied to a space, other than a discharge region of a pair of discharge electrodes, from which the gasified raw material can reach the discharge region, the raw material being irradiated in said space.

13. A method of generating extreme ultraviolet radiation according to claim 12, wherein the space to which the raw material is supplied is between the discharge region and a collector optical means, and wherein the energy beam irradiates the raw material in a surface region of the raw material that faces the discharge region.

14. A method of generating extreme ultraviolet radiation as described in claim 13, wherein the raw material supply means supplies the raw material in a plane that is perpendicular to an optical axis of the collector optical means and includes the center of the discharge region.

* * * * *